US009885537B2

(12) United States Patent
Tippmann, Jr. et al.

(10) Patent No.: US 9,885,537 B2
(45) **Date of Patent: *Feb. 6, 2018**

(54) PROJECTILE LAUNCHER WITH TRIGGER ASSIST

(71) Applicant: TIPPMANN SPORTS, LLC, Fort Wayne, IN (US)

(72) Inventors: Dennis J. Tippmann, Jr., Fort Wayne, IN (US); Kyle D. Smith, Hudson, IN (US); Brad R. Holloway, New Haven, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/195,300

(22) Filed: Jun. 28, 2016

(65) Prior Publication Data

US 2016/0305735 A1 Oct. 20, 2016

Related U.S. Application Data

(62) Division of application No. 14/204,336, filed on Mar. 11, 2014, now Pat. No. 9,395,146.

(60) Provisional application No. 61/778,999, filed on Mar. 13, 2013.

(51) Int. Cl.

| | |
|---|---|
| ***F41B 11/70*** | (2013.01) |
| ***F41B 11/723*** | (2013.01) |
| ***F41B 11/722*** | (2013.01) |
| ***F41A 19/10*** | (2006.01) |
| ***F41B 11/56*** | (2013.01) |

(52) U.S. Cl.
CPC ..... *F41B 11/723* (2013.01); *F41A 19/10* (2013.01); *F41B 11/56* (2013.01); *F41B 11/70* (2013.01); *F41B 11/722* (2013.01)

(58) Field of Classification Search
USPC ..... 124/71–77
See application file for complete search history.

(56) References Cited

U.S. PATENT DOCUMENTS

| | | | | |
|---|---|---|---|---|
| 4,275,521 A * | 6/1981 | Gerstenberger | F41A 19/58 | 42/84 |
| 5,711,286 A * | 1/1998 | Petrosyan | F41B 11/62 | 124/53 |
| 5,713,150 A * | 2/1998 | Ealovega | F41A 19/59 | 42/84 |
| 6,470,872 B1 * | 10/2002 | Tiberius | F41B 11/51 | 124/56 |

(Continued)

*Primary Examiner* — Michael David
(74) *Attorney, Agent, or Firm* — Barnes & Thornburg LLP

(57) ABSTRACT

A projectile launcher including a receiver with a breech proximate to a barrel. A valve assembly is provided that allows selective flow between a source of compressed gas and the breech. A trigger is provided that is movable between a first position and a second position. The launcher includes a firing assembly configured to actuate the valve assembly responsive to the trigger being in the second position. In some embodiments, the firing assembly includes a trigger assist feature configured to cycle the firing assembly in a fully automatic manner when the trigger is in the second position without reciprocating the trigger during the firing cycle. In some embodiments, the receiver includes an opening with a puncture mechanism dimensioned to receive a magazine.

5 Claims, 29 Drawing Sheets

(56) References Cited

U.S. PATENT DOCUMENTS 6,494,194 B2 * 12/2002 Shipachev ..... F41A 9/76 124/31
6,550,468 B1 * 4/2003 Tippmann, Jr. ..... F41B 11/721 124/31
6,810,870 B1 * 11/2004 Hu ..... F41B 11/721 124/73
7,237,543 B2 * 7/2007 Su ..... F41B 11/56 124/71
7,387,117 B2 * 6/2008 Kunimoto ..... F41B 11/721 124/73
7,398,776 B2 * 7/2008 Casas Salva ..... F41B 11/56 124/74
D587,766 S * 3/2009 Tippmann ..... D21/573
7,594,502 B1 * 9/2009 Anderson ..... F41B 11/57 124/71
7,726,293 B2 * 6/2010 Wei ..... F41B 11/723 124/73
7,757,682 B2 * 7/2010 Kaminker ..... F41A 9/61 124/56
7,856,969 B2 * 12/2010 Maeda ..... F41B 11/51 124/71
7,861,701 B1 * 1/2011 Wei ..... F41B 11/55 124/73
7,921,838 B2 4/2011 Tippmann, Jr. et al.
7,950,381 B2 * 5/2011 Maeda ..... F41A 9/73 124/45
7,950,382 B2 * 5/2011 Maeda ..... F41B 11/55 124/73
8,146,580 B2 * 4/2012 Wei ..... B25C 1/08 124/74
8,176,907 B2 * 5/2012 Wei ..... F41B 11/56 124/45
8,312,870 B2 * 11/2012 Higgins ..... F41B 11/57 124/1
9,109,853 B2 * 8/2015 Higgins ..... F41B 11/57
9,395,146 B2 * 7/2016 Tippmann, Jr. ..... F41B 11/722
2004/0055588 A1 * 3/2004 Rice ..... F41A 17/06 124/71
2009/0025701 A1 * 1/2009 Douglas ..... F41B 11/57 124/77
2009/0120420 A1 * 5/2009 Tippmann, Jr. ..... F41A 35/00 124/73
2010/0224180 A1 * 9/2010 Tippmann, Jr. ..... F41A 35/00 124/74
2011/0226227 A1 * 9/2011 Douglas ..... F41B 11/57 124/77
2011/0259183 A1 * 10/2011 Compton ..... F41A 19/59 89/28.1
2015/0007804 A1 * 1/2015 Tippmann, Jr. ..... F41B 11/722 124/73

* cited by examiner

PROJECTILE LAUNCHER WITH TRIGGER ASSIST

RELATED APPLICATIONS

This is a divisional application of U.S. application Ser. No. 14/204,336 filed Mar. 11, 2014, which claimed the benefit of U.S. Provisional Application No. 61/778,999, filed Mar. 13, 2013, both of which are hereby incorporated by reference in their entirety.

TECHNICAL FIELD

The present invention generally relates to projectile launchers for firing non-lethal projectiles, such as paintballs or air-soft pellets. In particular, embodiments of the invention include a trigger assist that allows full automatic firing while the trigger is pulled, without requiring the user's trigger finger to move back-and-forth between cycles. In some cases, the projectile launcher includes a selector switch for selectively allowing a user to switch between semi-automatic firing, full automatic firing and a safe mode. Embodiments are also contemplated in which the launcher can be configured with multiple ways of supplying compressed gas to provide flexibility. In some embodiments, for example, the source of compressed gas could be a cartridge housed in a magazine that is detachable from the launcher.

BACKGROUND

Devices that fire projectiles using compressed gas are known in the art. For example, airsoft guns and paintball markers typically use compressed gas to propel plastic pellets and frangible projectiles, respectively. These types of devices have a wide variety of applications. For example, a popular recreational use is in simulated war games, in which opposing sides attempt to seek out and "shoot" one another with projectiles. Frangible projectiles have also been used to segregate cattle within a herd. Likewise, law enforcement personnel employ frangible projectiles with immobilizing materials for crowd control. In some situations, it is desirable to shoot projectiles in a full automatic mode in which the user makes a single trigger pull to fire multiple projectiles.

It can also be desirable to have flexibility in how compressed gas is supplied to the device. Typically, a compressed gas cartridge is forced into a puncture mechanism with a set screw, which is inconvenient and time consuming. Moreover, existing magazines include multiple components, such as a puncture mechanism and a valve assembly, which increases complexity and cost. There is a need for more flexibility and convenience in supplying compressed gas to these types of devices.

According to one aspect, this disclosure provides a projectile launcher with a barrel dimensioned to receive a projectile. The launcher includes a receiver with a breech proximate to the barrel. A valve assembly is provided that allows selective flow between a source of compressed gas and the breech. A trigger is provided that is movable between a first position and a second position. The launcher includes a firing assembly configured to actuate the valve assembly responsive to the trigger being in the second position. In some embodiments, the firing assembly includes a trigger assist feature configured to cycle the firing assembly in a fully automatic manner when the trigger is in the second position without reciprocating the trigger during the firing cycle.

Depending on the circumstances, the projectile launcher could include the trigger assist feature having a trigger assist coupled with the trigger using a spring. For example, the trigger assist could be movable between a firing position in which the firing assembly actuates the valve assembly and a cocked position. In some cases, the launcher may include a piston in fluid communication with the valve assembly that moves upon venting of the valve assembly to apply a force to the trigger assist sufficient to overcome the spring to move the trigger assist from the firing position to the cocked position.

Embodiments are contemplated in which the launcher includes a selector switch movable between a safe position, a semi-automatic position, and a full-automatic position. In some cases, the selector switch is shaped to block the trigger from moving to the second position when in the safe position. The selector switch could be shaped to block movement of the piston when in the semi-automatic position and allow free movement of the trigger to the second position. However, in the full automatic position, the selector switch is shaped to allow free movement of the piston and allow free movement of the trigger to the second position.

According to another aspect, this disclosure provides a method of using a projectile launcher in which a pneumatic gun is provided that includes a trigger movable between a firing position and a released position. The trigger initiates a trigger assist feature to vent of compressed gas to propel projectiles out of the pneumatic gun. In response to moving the trigger to the firing position, projectiles are propelled out of the pneumatic gun in a fully automatic manner by the trigger assist feature repeatedly venting the pneumatic gun. Typically, the trigger is approximately stationary in the firing position without reciprocating during the firing cycle of the pneumatic gun. In some cases, the trigger assist feature includes a trigger assist that reciprocates to vent the pneumatic gun without moving the trigger from the firing position. In some embodiments, the trigger assist feature includes a piston that reciprocates during operation of the pneumatic gun without moving the trigger.

According to a further aspect, the disclosure provides a projectile launcher with a magazine dimensioned to carry a plurality of projectiles. The magazine includes a cavity dimensioned to receive a cartridge of compressed gas and extends longitudinally transversely to the barrel axis. The receiver an opening dimensioned to receive the magazine. The receiver includes a puncture mechanism configured to pierce a seal of a compressed gas cartridge disposed in the cavity of the magazine. The launcher includes a valve assembly configured to selectively allow flow between a source of compressed gas and the breech. A firing assembly actuates the valve assembly responsive to a trigger pull. In some embodiments, the receiver and/or the magazine includes a latch mechanism configured to releasably couple the magazine to the receiver. For example, the puncture mechanism may include a piercing pin with a tip covered by a spring-loaded wall. When a force is applied by insertion of the magazine, this could overcome the spring-loaded wall to expose the tip of the piercing pin. However, in some cases, the latch mechanism could be configured to allow coupling of the magazine to the receiver without overcoming the spring force of the spring-loaded wall, thereby not exposing the tip of the piercing pin. In some embodiments, the receiver defines a first flow path between the magazine and the valve assembly and a second flow path between the valve assembly and a grip portion of the receiver.

BRIEF DESCRIPTION OF THE DRAWINGS

The present disclosure will be described hereafter with reference to the attached drawings which are given as non-limiting examples only, in which.

Figure 1:
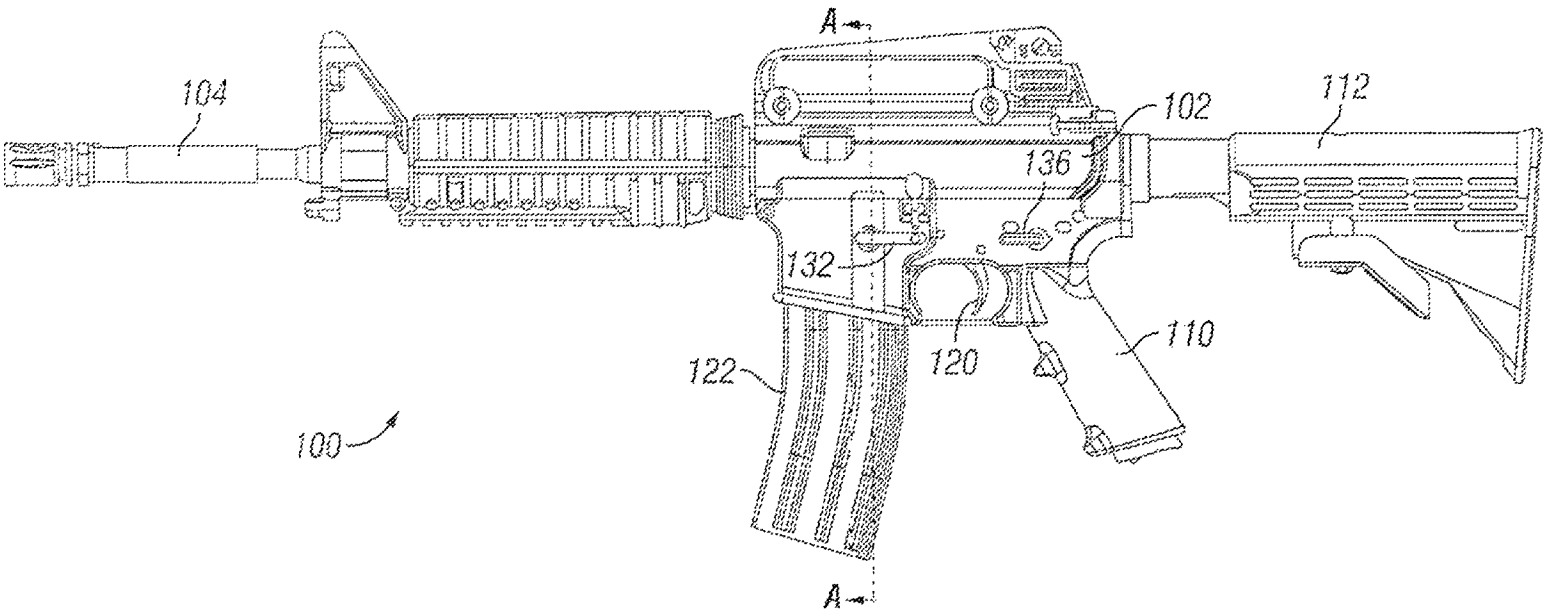
FIG. 1 is a left side view of an example projectile launcher according to one embodiment of the present invention.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

FIG. 1 is a left side view of an example projectile launcher 100 that may be used to launch a projectile using compressed gas, such as carbon dioxide, air or nitrogen. The projectile launcher 100 may be used to launch a variety of projectiles. Typically, the projectile launcher 100 would be used to launch non-lethal projectiles that would be similar to those used in conjunction with other compressed gas guns, such as paintball markers, air rifles, pellet rifles, etc. By way of example only, the projectile launcher 100 may launch paintballs, BBs, pellets, air-soft pellets, darts, spark balls, pepper balls, etc.

Figure 2:
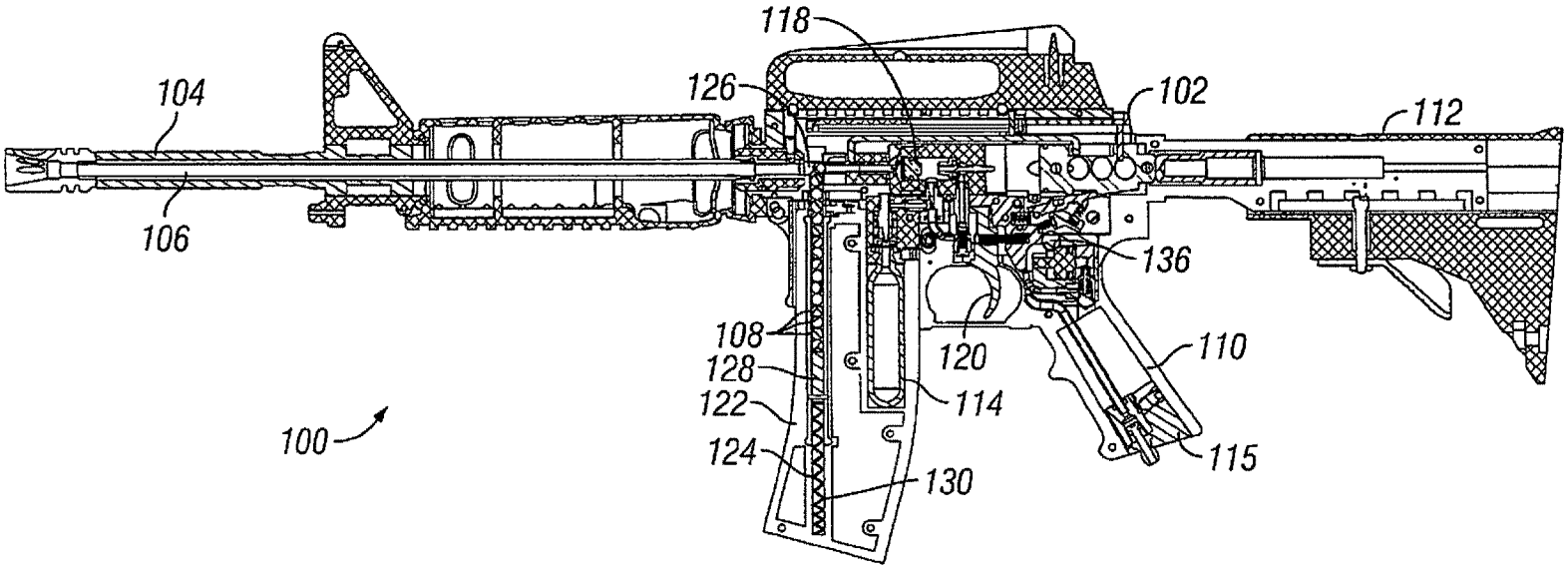
FIG. 2 is a side cross-sectional view of the example projectile launcher shown in FIG. 1.

Referring to FIGS. 1 and 2, the projectile launcher 100 includes a receiver 102 defining an internal cavity. The receiver 102 may be a unitary member or multiple pieces that are coupled together, such as the example shown. As used herein, the term "coupled" is broadly intended to encompass both direct and indirect connections.

In the example shown, the projectile launcher 100 includes a barrel 104 extending from the receiver 102. The barrel 104 attaches to the receiver 102, such as by screwing, interference fit, frictional fit, or unitary formation. The barrel 104 includes a bore 106 dimensioned to receive a projectile 108 (FIG. 2). The bore 106 may be dimensioned to receive projectiles of different sizes, including but not limited to air-soft pellets and/or a 0.68 caliber paintball. When the projectile launcher 100 is fired, a projectile 108 passes through and exits out the barrel 104.

As shown, the projectile launcher 100 includes a grip 110 that is dimensioned for a user to grasp. In the example shown, the projectile launcher 100 is shaped like a rifle with a buttstock 112. However, the projectile launcher 100 could have a variety of other shapes with or without a buttstock 112.

Figure 27:
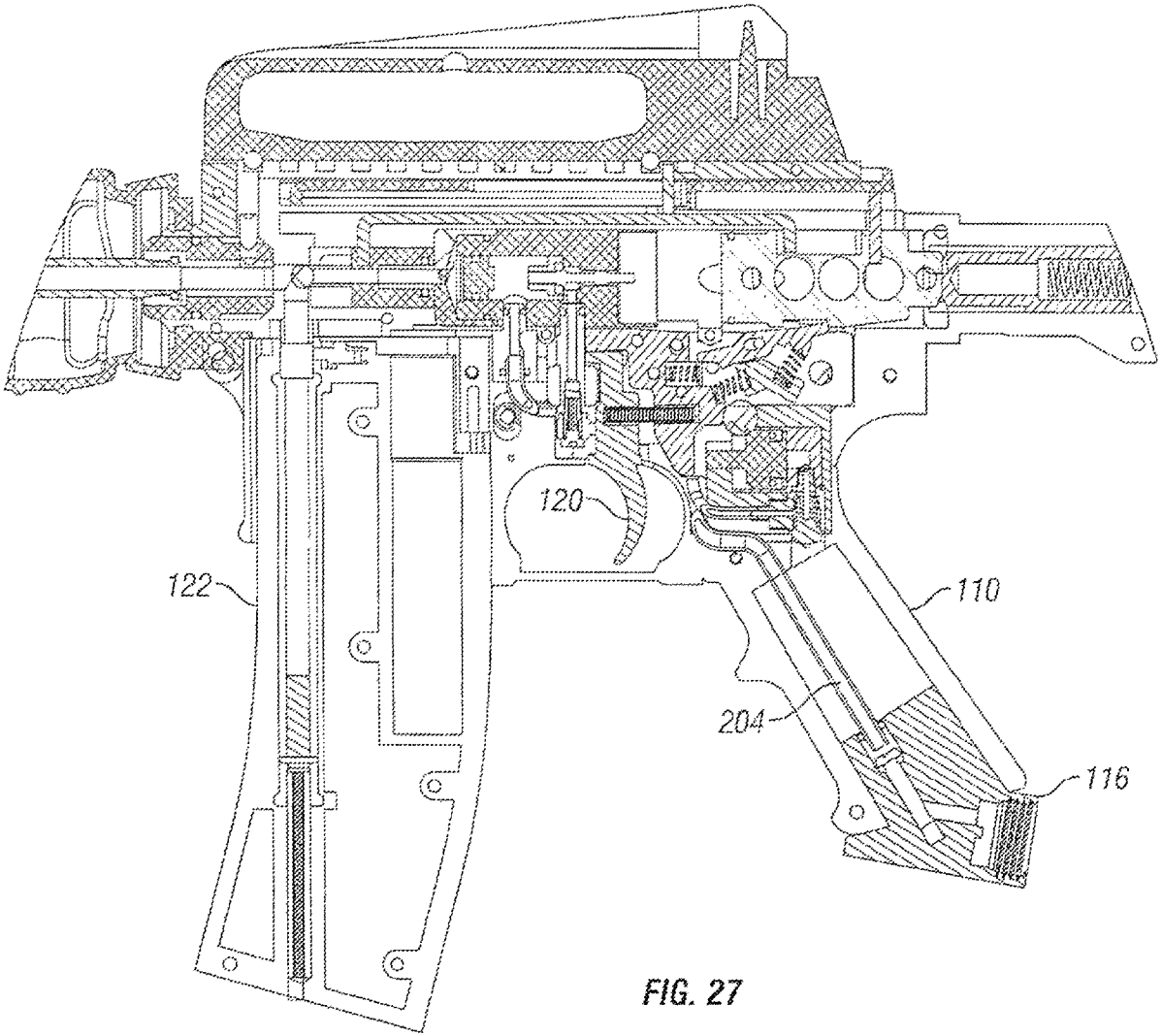
FIG. 27 is a side cross-sectional view of the example projectile launcher showing an input fitting distributing compressed gas from a tank adapter to a valve assembly.

As discussed above, the projectile launcher 100 uses compressed gas to propel a projectile 108 out of the receiver 102 through the barrel 104. In the example shown, multiple manners of supplying the projectile launcher 100 with compressed gas are provided. In the example of FIG. 2, a cartridge of compressed gas 114 could be used as the source of compressed gas for propelling projectiles 108. Likewise, a remote line fitting 115 could be coupled with a source of compressed gas, such as a remote tank of compressed gas. In other embodiments, a tank adapter 116 could be used to couple a tank of compressed gas directly with the projectile launcher 100 (FIG. 27). These different sources of compressed gas are in fluid communication with a valve assembly 118 that selectively vents compressed gas to propel a projectile 108 out of the projectile launcher 100. In the example shown, a trigger 120 is configured to initiate actuation of the valve assembly 118 so that compressed gas is vented when a user pulls the trigger 120, thereby propelling a projectile 108.

In the example shown, the projectile launcher 100 includes a magazine 122 configured to supply a plurality of projectiles 108 to a breech area of the projectile launcher 100 where the projectile 108 is ready for launching. In the example shown, the magazine 122 includes a channel 124 with an open end 126 through which projectiles feed into the breech area of the projectile launcher 100. A pusher 128 is positioned within the channel 124 behind the last projectile to be fed into the breech area. In conjunction with a spring 130, the pusher 128 urges the projectiles 108 towards the breech area. In this example, the receiver 102 includes a latch 132 (FIG. 1) that couples the magazine 122 with the receiver 102. In the embodiment shown, a user would actuate a release 134 to uncouple the magazine 122 from the receiver 102 so that the magazine 122 could be removed, such as to refill the channel 124 with additional projectiles 108.

In the example shown, the receiver 102 includes a selector switch 136. As shown, the selector switch 136 allows a user to change modes in which the projectile launcher fires. In the safe mode, the projectile launcher 100 will not fire projectiles, even if the trigger 120 is pulled. In the semi-automatic mode, the projectile launcher 100 requires the trigger 120 to be pulled each time to launch a projectile. In the full automatic mode, the projectile launcher will continue to fire projectiles 108 while the trigger 120 is pulled by the user. Accordingly, in full automatic mode, multiple projectiles may be launched while the user continues to pull the trigger 120. As discussed below, the user's finger does not move while the launcher 100 continues to fire in full automatic mode, which is in contrast to existing launchers, such as shown in Pat. No. 6,550,468, that require the user's trigger finger to move back-and-forth with the trigger movement while the launcher goes through firing cycles in full automatic mode.

In the example shown, the selector switch 136 rotates between the safe, semi-automatic, and full automatic modes. However, the selector switch 136 could move between modes using a linear motion or other types of movement. Moreover, embodiments are contemplated with a single firing mode, such as full-automatic. In such embodiments, the selector switch 136 would be movable only between a safe mode and a full-automatic mode without a semi-automatic mode. In some cases, the selector switch 136 may be optional. For example, the launcher 100 may only fire in the full-automatic mode and a safety mechanism could be implemented in a manner other than the selector switch 136.

Figure 3:
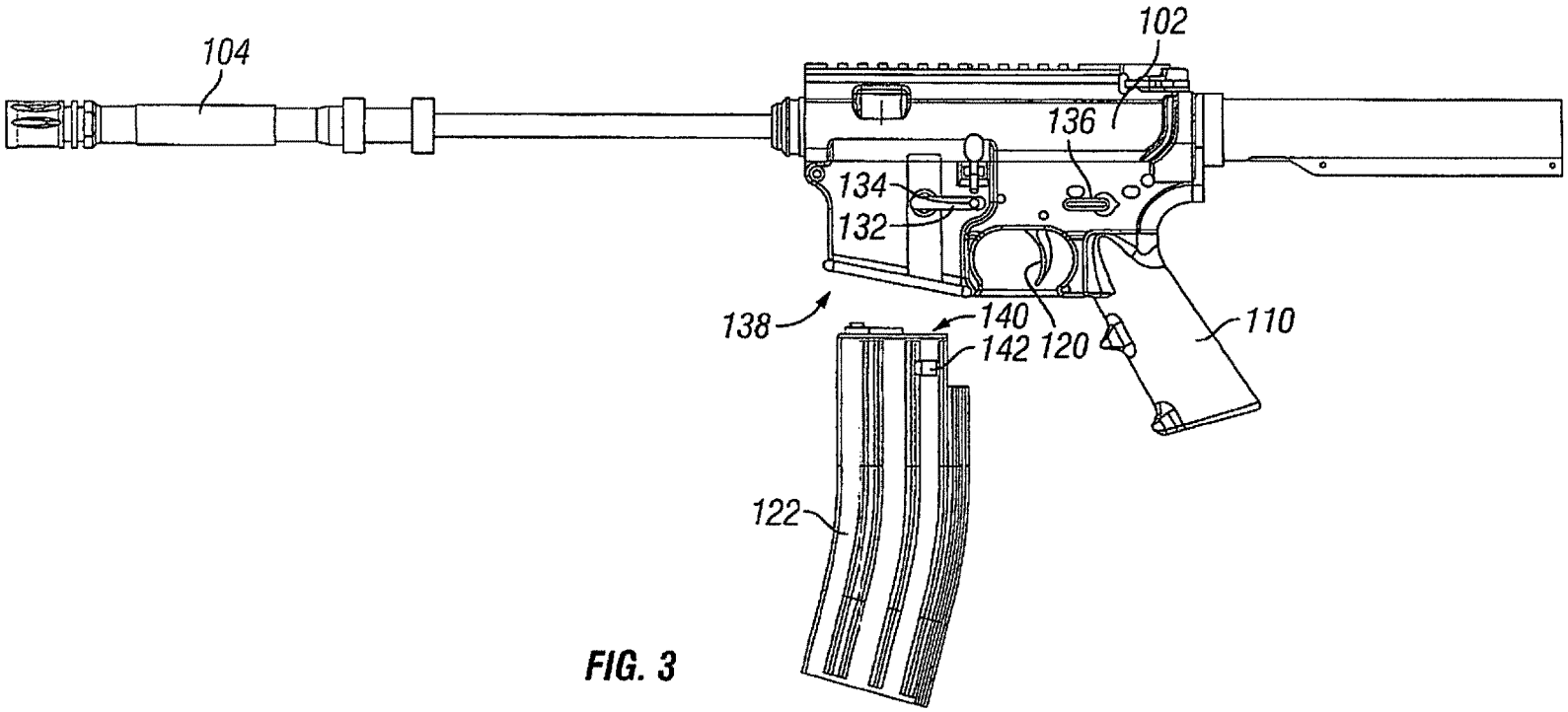
FIG. 3 is a left side view of the example projectile launcher prior to insertion of the magazine.

FIG. 3 shows the example projectile launcher 100 from FIGS. 1 and 2 with the magazine 122 ready for insertion into the receiver 102. In the example shown, the receiver 102 includes an opening 138 that is dimensioned to receive a leading end 140 of the magazine 122. When the leading end 140 of the magazine 122 is inserted into the opening 138, the latch 132 engages an opening 142 in the magazine 122 to couple the magazine 122 with the receiver 102. In this example, if the user wants to remove the magazine 122, the release 134 (FIG. 4) is pushed to release the latch 132 from the opening 142.

Figure 4:
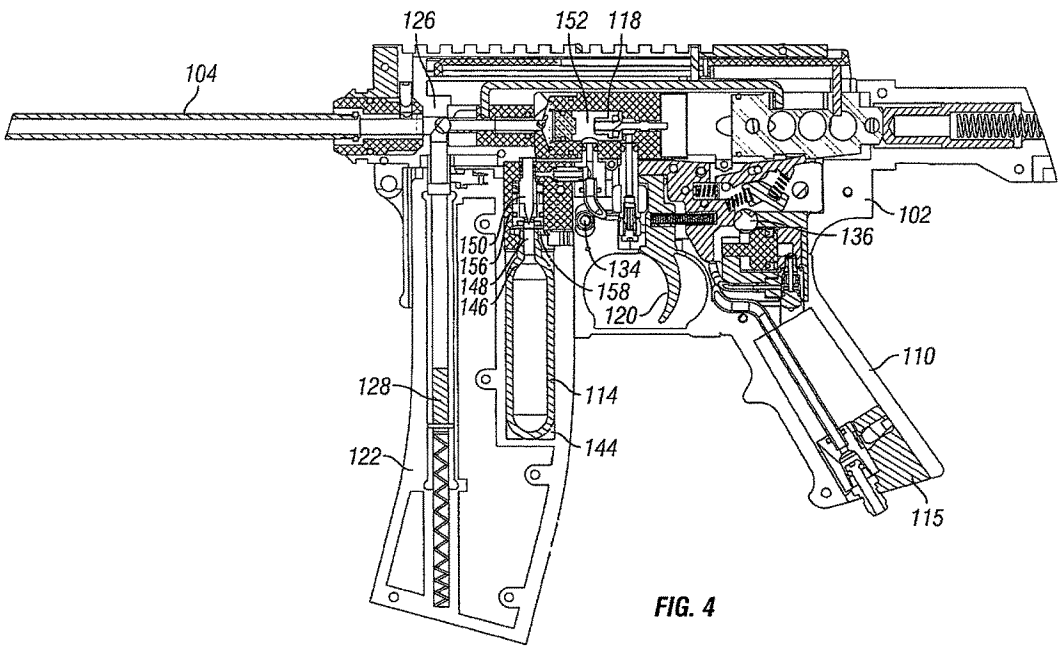
FIG. 4 is a side cross-sectional view of the example projectile launcher.

FIG. 4 is a side cross-sectional view of the projectile launcher 100 showing the magazine 122 inserted into the receiver 102. In the example shown, the magazine includes a cavity 144 that is dimensioned to receive a cartridge 114 of compressed gas. In some cases, for example, the cartridge 114 may hold 12 grams of compressed gas. In the example shown, the cartridge 114 has a sloped neck 146 that terminates in a mouth 148. Typically, the mouth 148 is initially covered with a seal, such as a foil, to prevent escape of compressed gas from the cartridge 114. As shown, the mouth 148 is adjacent a piercing pin 150 with a tip that is sufficiently sharp to pierce the seal initially covering the mouth 148 of the cartridge 114, thereby releasing compressed gas into a chamber 152. The piercing pin 150 is disposed in a wall that includes grooves for a seal 156 to prevent escape of gas. A seal 158 also surrounds the mouth 148 of the cartridge 114 to prevent escape of gas. The wall 154 is spring-loaded so the tip of the piercing pin 150 is exposed to the seal covering the mouth 148 of the cartridge 114 when the magazine 122 is pushed into the receiver 102. Accordingly, when the magazine 122 is sufficiently pushed into the receiver 102 to overcome the force of the spring-loaded wall 154, this exposes the tip of the piercing pin 150 to pierce the seal covering the mouth 148 of the cartridge 114. The pressure from the compressed gas released from the cartridge 114 and spring urging the wall in the opposite direction secures the cartridge 114 into the cavity 144.

This embodiment is distinct from existing magazines, which are more complex. For example, many of the components disposed in existing magazines, such as a valve assembly and puncture mechanism are disposed in the receiver 102 in the example shown instead of the magazine 122. Additionally, the ability to house the cartridge 114 in the magazine without an internal puncture mechanism is another distinction from existing magazines. By making the puncture assembly and valve assembly internal components to the receiver 102, this allows flexibility in the manner by which compressed gas can be supplied to the valve assembly as discussed below.

Figure 5:
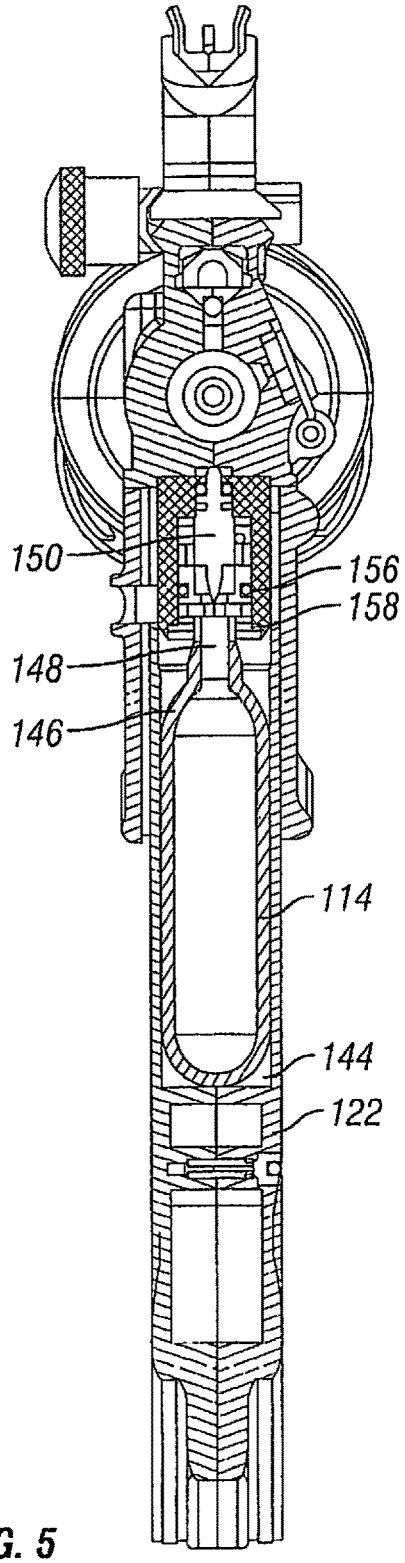
FIGS. 5-7 are front cross-sectional views showing insertion of the magazine to puncture the cartridge, thereby releasing compressed gas.

FIG. 5 is a front cross-sectional view of the projectile launcher 100 showing the magazine 122 being gently inserted into the receiver 102, such that the magazine 122 is not inserted to a point where the cartridge 114 would be punctured or such that the force by which the magazine 122 is inserted does not overcome the spring-loaded wall 154, thereby not piercing the seal covering the mouth 148 of the cartridge 114. Accordingly, a user may place an extra cartridge 114 in the magazine 122 for purposes of storage without breaking the seal on the mouth 148 of the cartridge.

Figure 6:
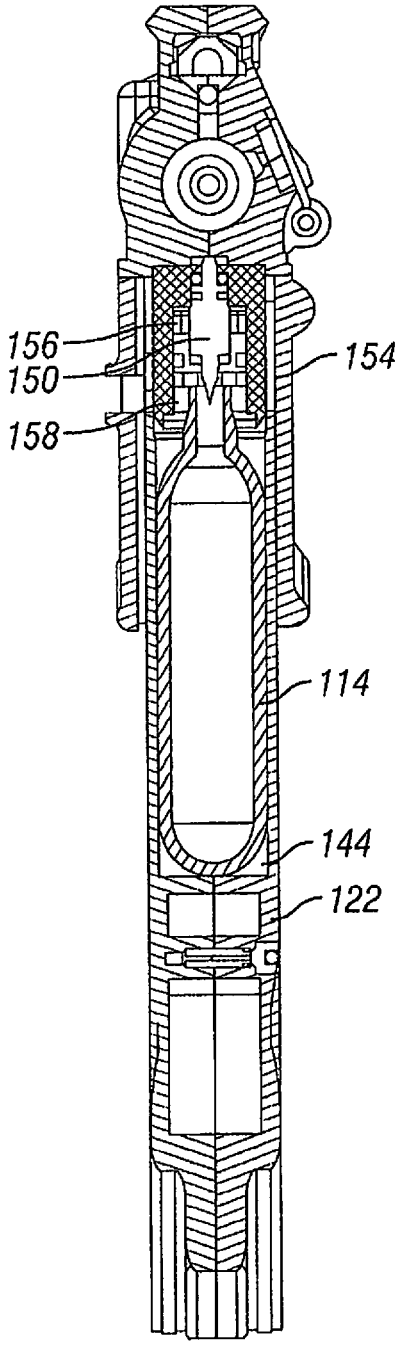

FIG. 6 is a front cross-sectional view showing the magazine inserted sufficiently to overcome the spring-loaded wall 154, thereby exposing the seal covering the mouth 148 of the cartridge 114 to the piercing pin and releasing the gas in the cartridge 114.

Figure 7:
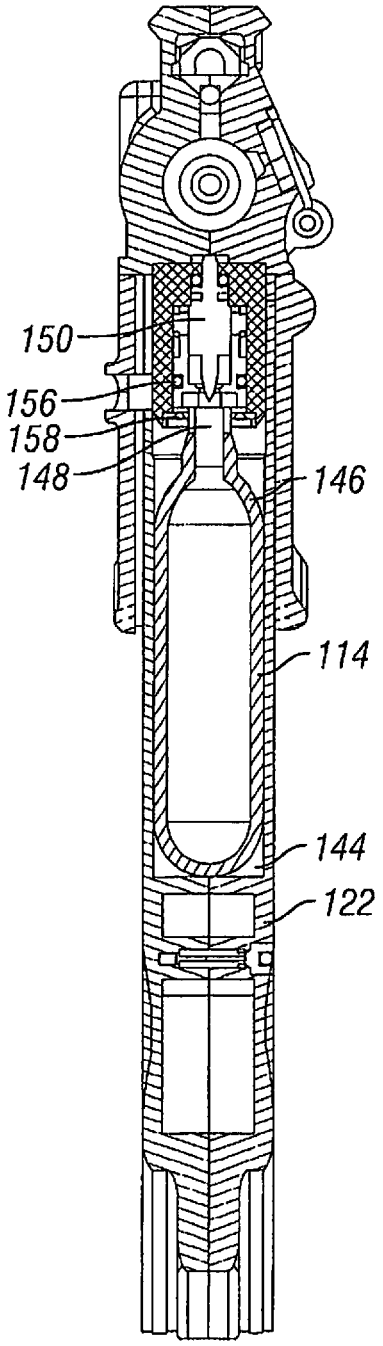

FIG. 7 is a front cross-sectional view of the projectile launcher after the seal on the mouth 148 of the cartridge 114 has been punctured.

Figure 8:
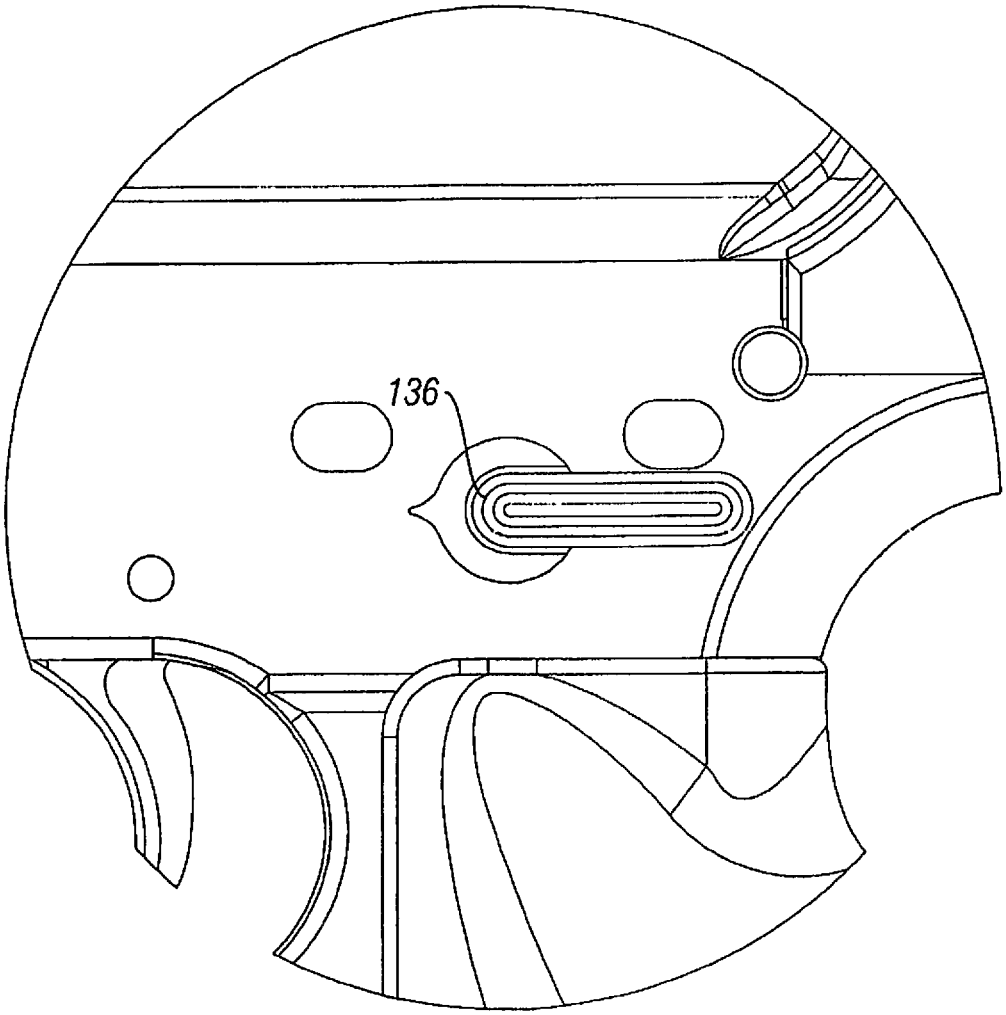
FIG. 8 is a detailed side view of the receiver showing the selector switch according to one embodiment of the present invention.

FIG. 8 is a detailed view of the receiver 102 showing the selector switch 136. In this example, the selector switch 136 is in safe mode. As discussed above, however, the selector switch 136 may be used to select a safe, semi-automatic, and full automatic mode.

Figure 9:
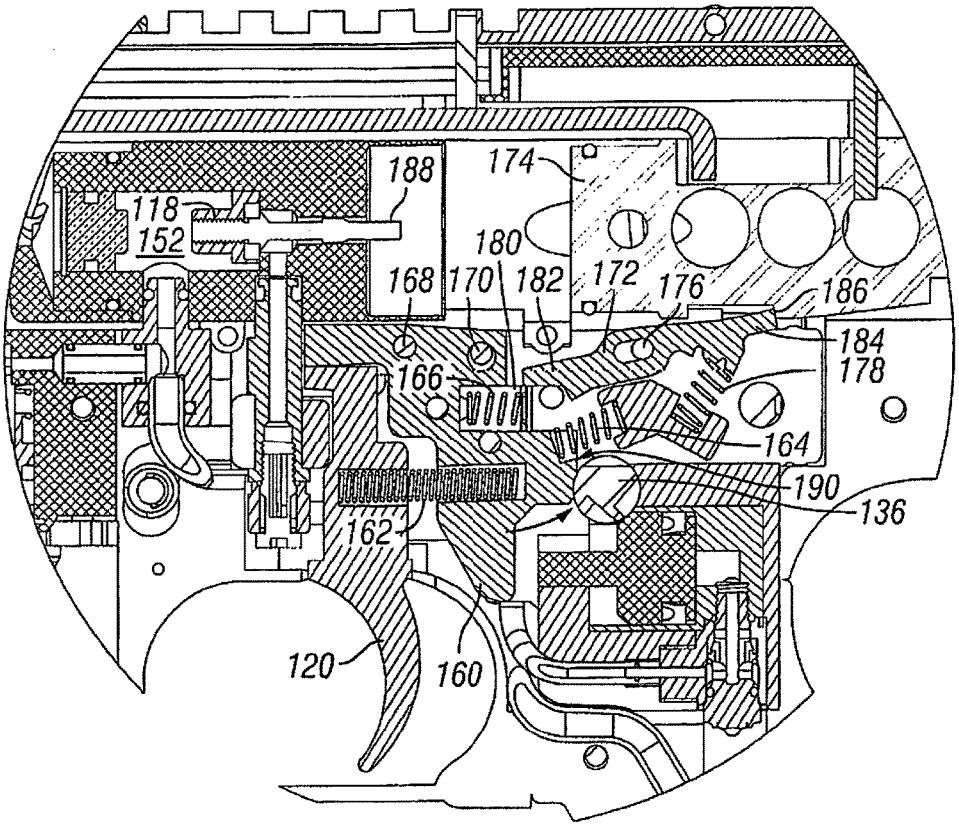
FIGS. 9-10 are detailed side cross-sectional views showing the projectile launcher with the selector switch in the safe mode.

FIG. 9 is a detailed cross-sectional view of a portion of the receiver 102 with the selector switch 136 in safe mode. In the example shown, the trigger 120 is coupled with a trigger assist 160 (which is a rear trigger in the embodiment) using a spring 162. The trigger assist 160 moves under the bias of a first spring 162 and a second spring 164. The trigger assist 160 pivots about pivot pin 168, but movement is limited by stop 170. A sear 172 is interposed between the trigger assist 160 and a rear bolt 174. In this example, the sear 172 is disposed on a pivot pin 176 and is biased by a spring 178 to urge engagement with the rear bolt 174. As shown, the trigger assist 160 includes a ridge 180 that engages a first end of the sear 172 while a second end 184 of the sear 172 engages a ridge 186 on the rear bolt 174. When in the cocked position, such as shown, actuation of the trigger assist 160 releases the rear bolt 174 from the sear 172. As discussed below, releasing the rear bolt 174 causes the rear bolt to move under the urging of a drive spring 173 (FIG. 22) into a stem 188 of the valve assembly 118, thereby releasing compressed gas from the chamber 152.

Figure 10:
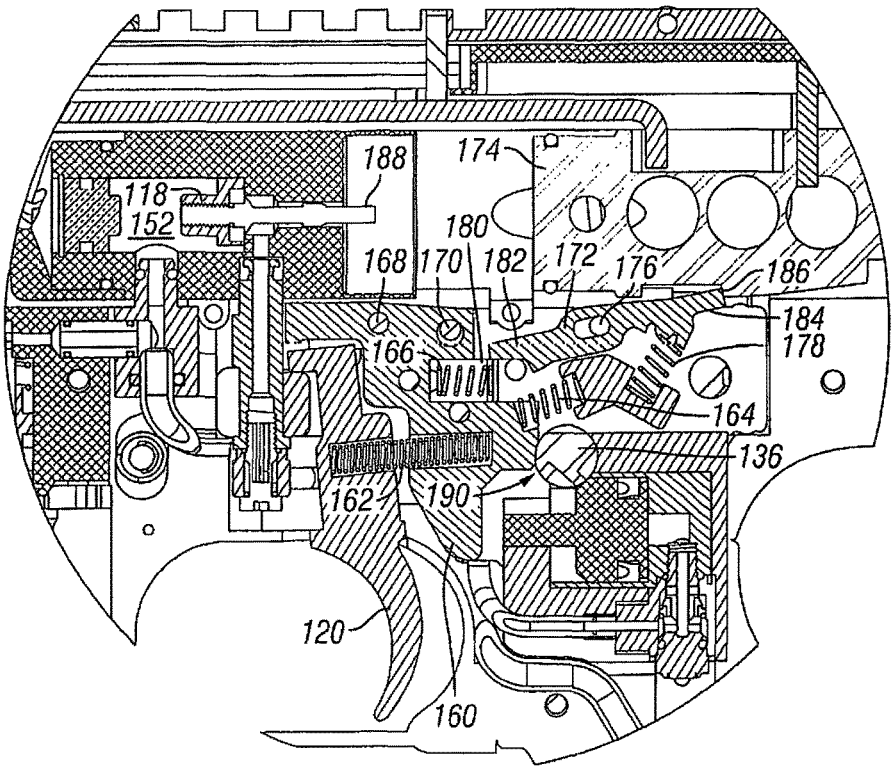
Figure 11:
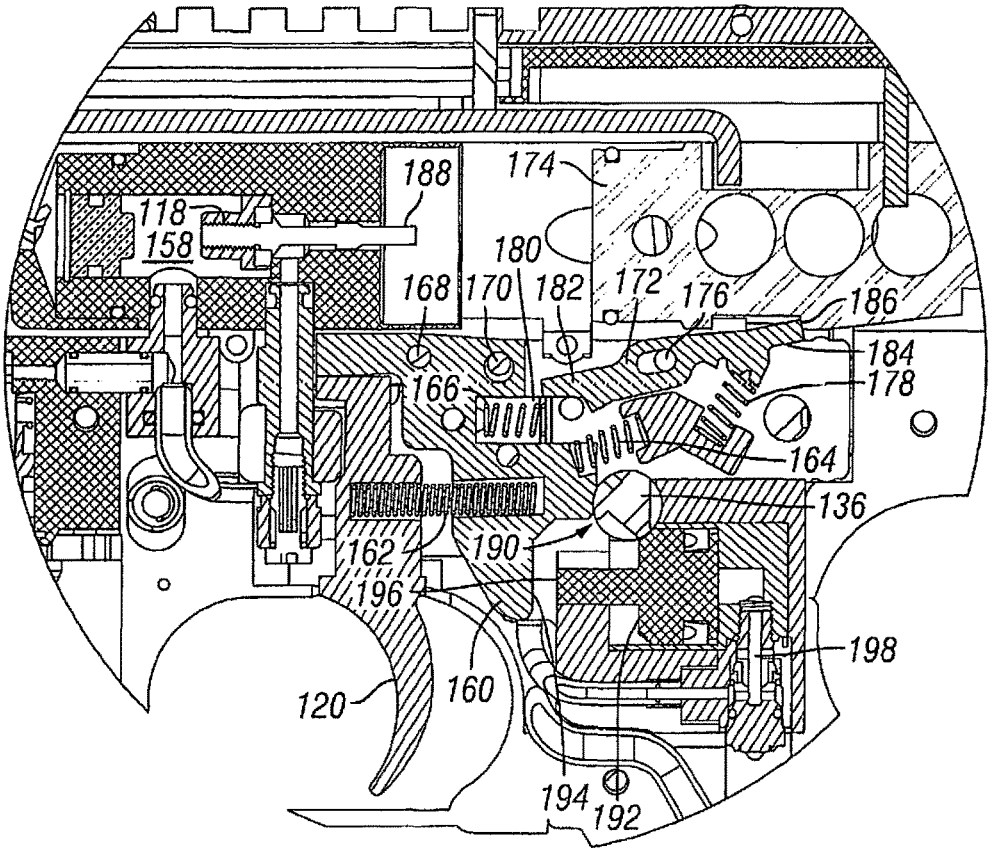
FIGS. 11-15 are detailed side cross-sectional views showing the projectile launcher with the selector switch in the semi-automatic mode.

In the safe mode, as shown in FIG. 9, the selector switch 136 blocks a rear portion 190 of the trigger assist, thereby preventing the trigger assist 160 from actuating the sear 172. Even if the user pulls the trigger 120 sufficiently to overcome the force of spring 162, such as shown in FIG. 10, the selector switch 136 prevents movement of the trigger assist 160, thereby preventing actuation of the sear to prevent firing of the projectile launcher 100.

Figure 12:
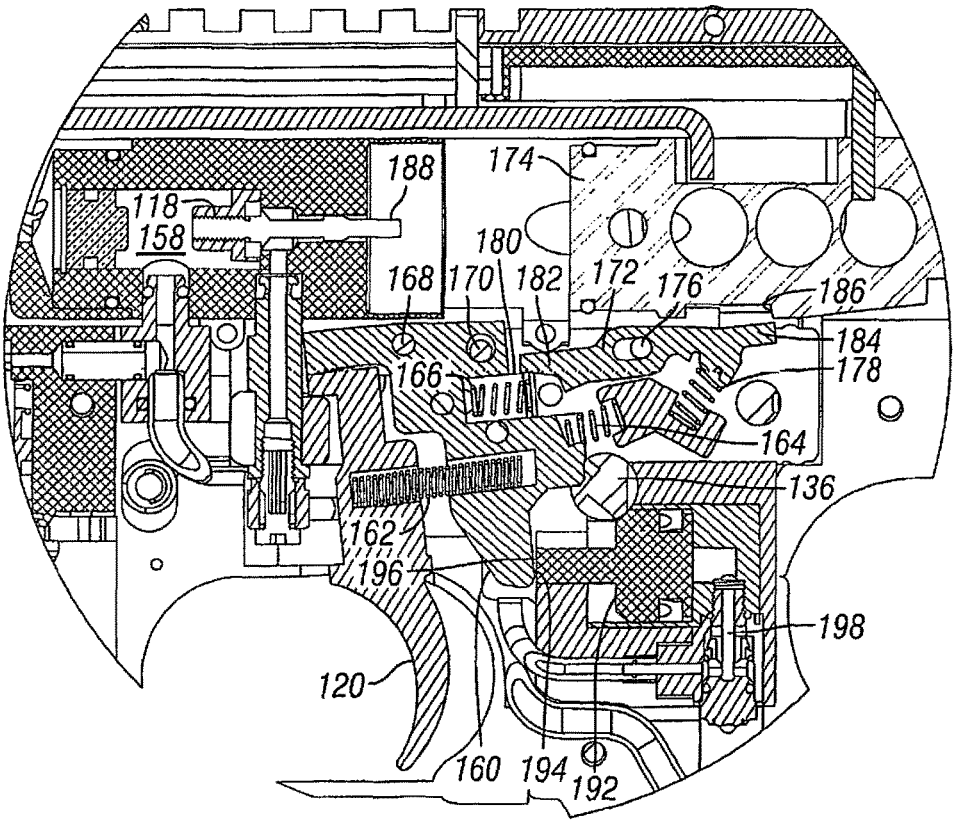
Figure 13:
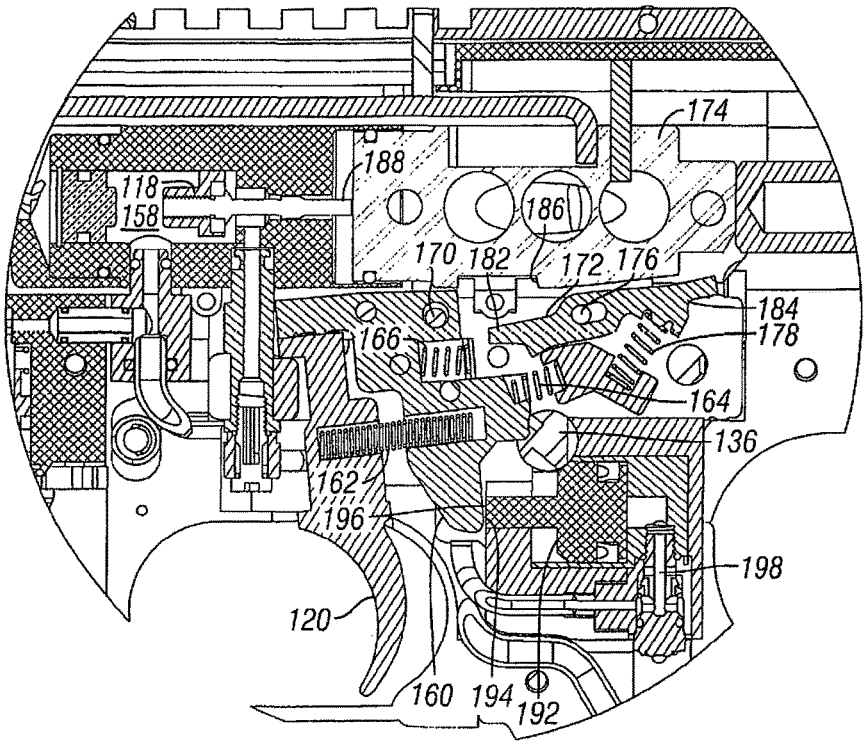

FIGS. 11-15 show a detailed cross-sectional view of the receiver 102 with the mode selector switch 136 in the semi-automatic mode progressing through a firing sequence. In this mode, the geometry of the selector switch 136 is such that the rear portion 190 of the trigger assist 120 is not impeded (as it was in safe mode) and can freely move when a user actuates the trigger 120. However, the selector switch 136 is configured to block a piston 192 when in the semi-automatic mode. As explained below with respect to the full automatic mode, the piston 192 has a leading end 196 that actuates the back portion 194 of the trigger assist 160 to reset the trigger assist 160 in full automatic mode. In the semi-automatic mode, as mentioned above, the selector switch 136 blocks a portion of the piston to prevent movement. As a result, the piston 192 remains stationary in the semi-automatic mode due to the selector switch 136. When the trigger 120 is pulled in this mode, as shown in FIG. 12, the force of the spring 162 is sufficient such that the trigger 120 and trigger assist 160 move in unison. As a result, the ridge 180 of the trigger assist 160 actuates the first end 182 of the sear 172, which rotates the sear 172 about the pivot pin 176. This releases the second end 184 of the sear 172 from the ridge 186 of the rear bolt 174. Due to a drive spring 173 urging the rear bolt 174 toward the valve stem 188, a leading end of the rear bolt 174 impacts the valve stem 188 to shift the position of the valve assembly 118. When the valve assembly 118 shifts in this manner, this vents compressed gas from chamber 158 to propel a projectile out of the projectile launcher 100. At the same time, there is a fluid path to propel the rear bolt 174 rearward to reset the rear bolt 174 with respect to the sear 172 for firing another projectile. Likewise, another fluid path to a flow control valve 198 supplies compressed gas to the piston 192, but the piston does not shift due to the obstruction caused by the selector switch 136 in the semi-automatic mode.

Figure 14:
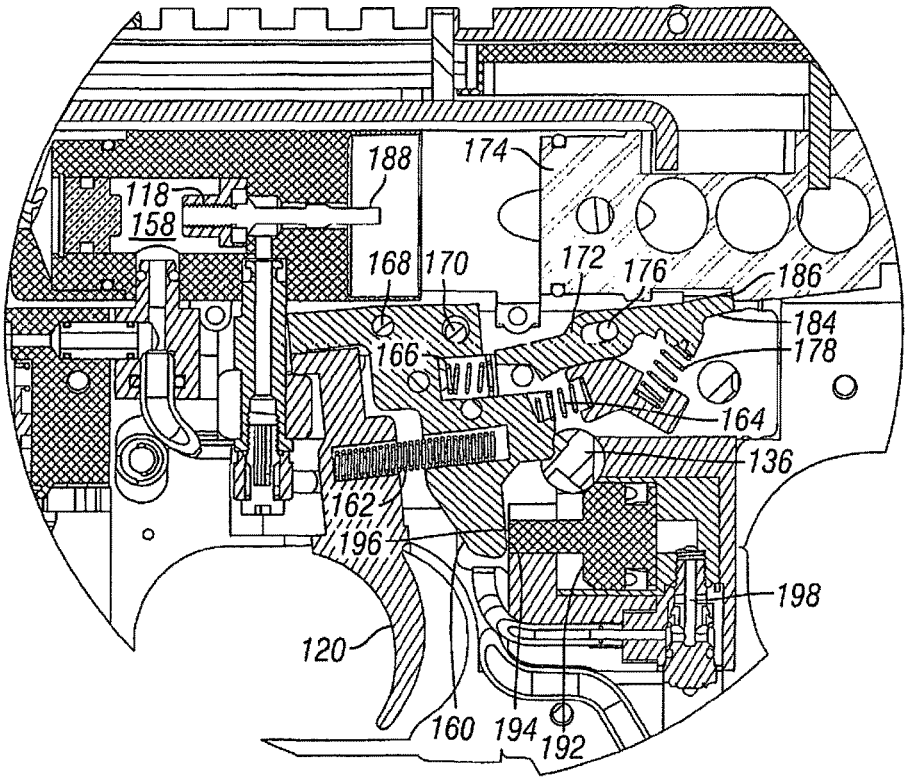

FIG. 14 shows the rear bolt 174 after traveling rearward due to compressed gas to recock, which latches the second end 184 of the sear 172 with the ridge 186 of the rear bolt 174.

Figure 15:
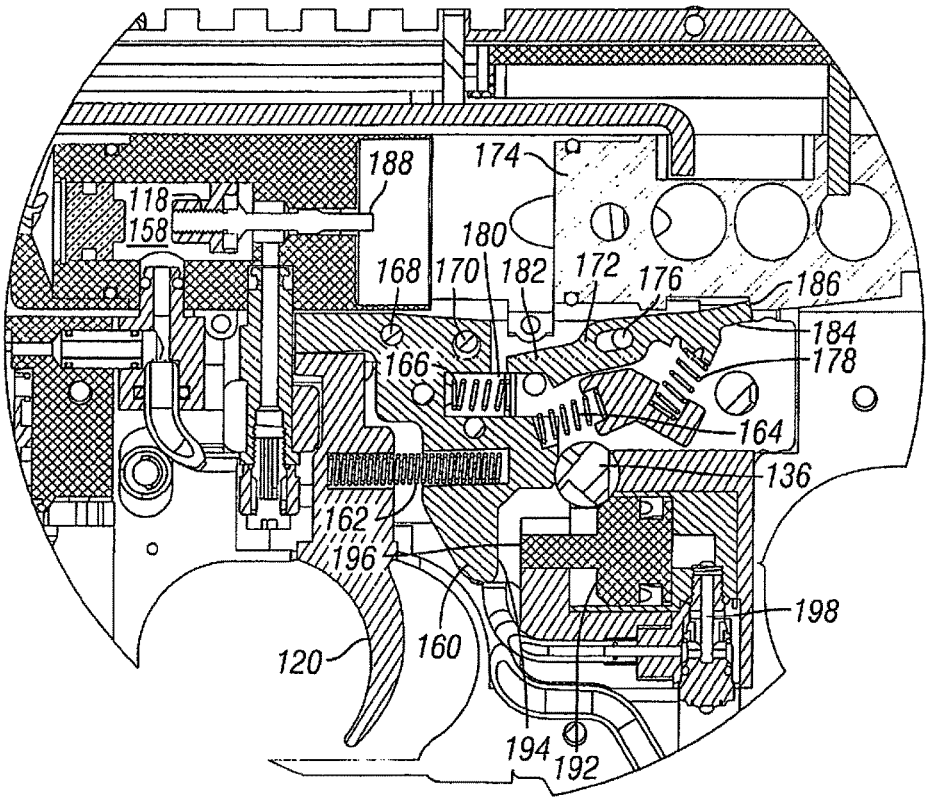

FIG. 15 shows the trigger after the user has released the trigger. As discussed above, the user must pull the trigger 120 each time to propel a projectile 108 out of the projectile launcher 100 in the semi-automatic mode.

Figure 16:
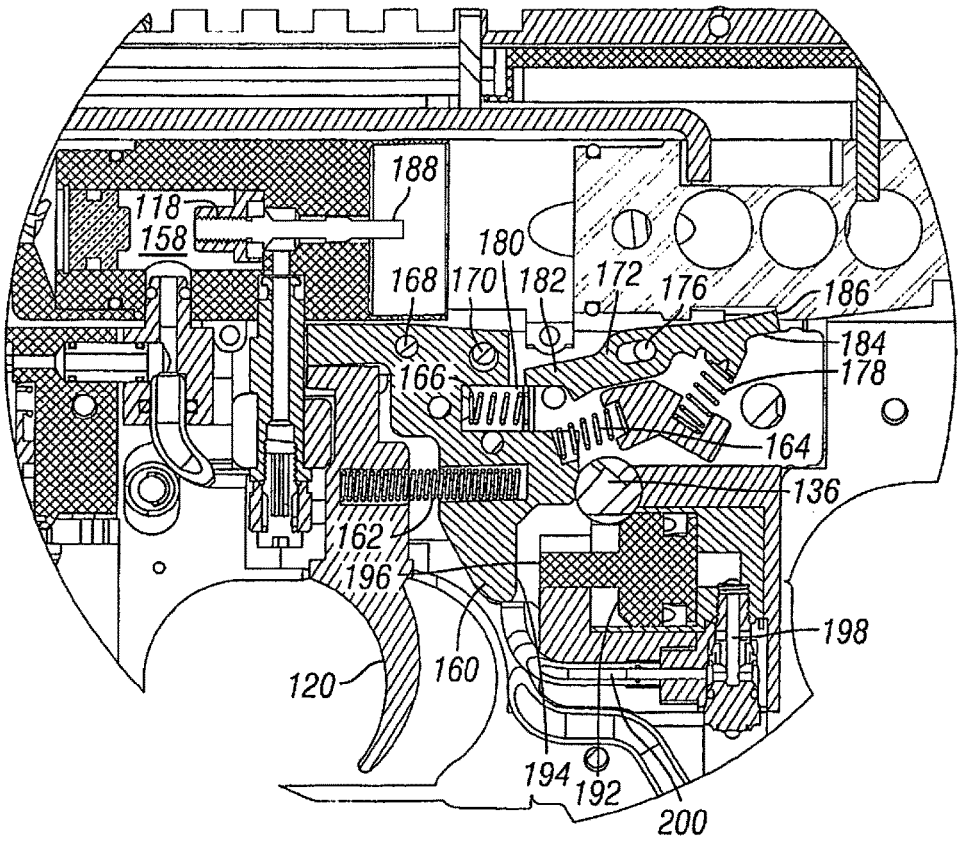
FIGS. 16-21 are detailed side cross-sectional views showing the projectile launcher with the selector switch in the full-automatic mode.

FIGS. 16 through 21 are detailed side cross-sectional views of the receiver 102 with the selector switch 136 set to the full automatic mode showing a firing sequence. In this mode, the selector switch 136 does not impede movement of the trigger assist 160, nor does the selector switch 136 impede movement of the piston 192. FIG. 16 shows the projectile launcher 100 in a cocked position ready to be fired.

Figure 17:
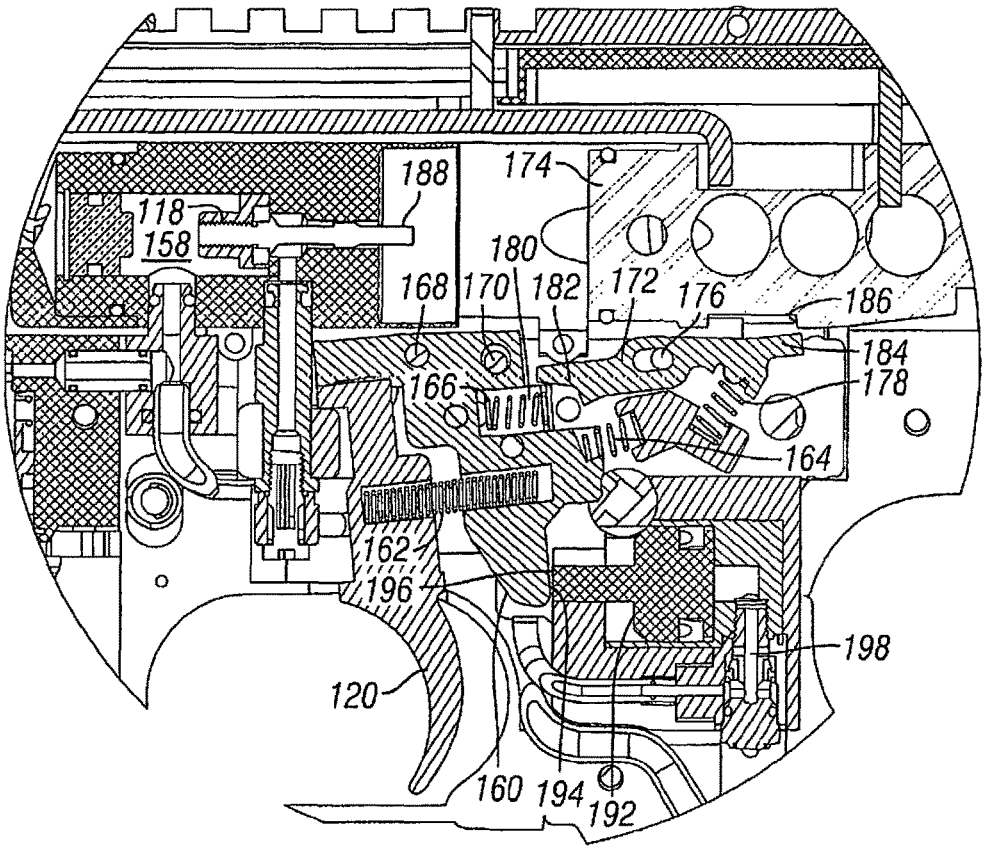
Figure 18:
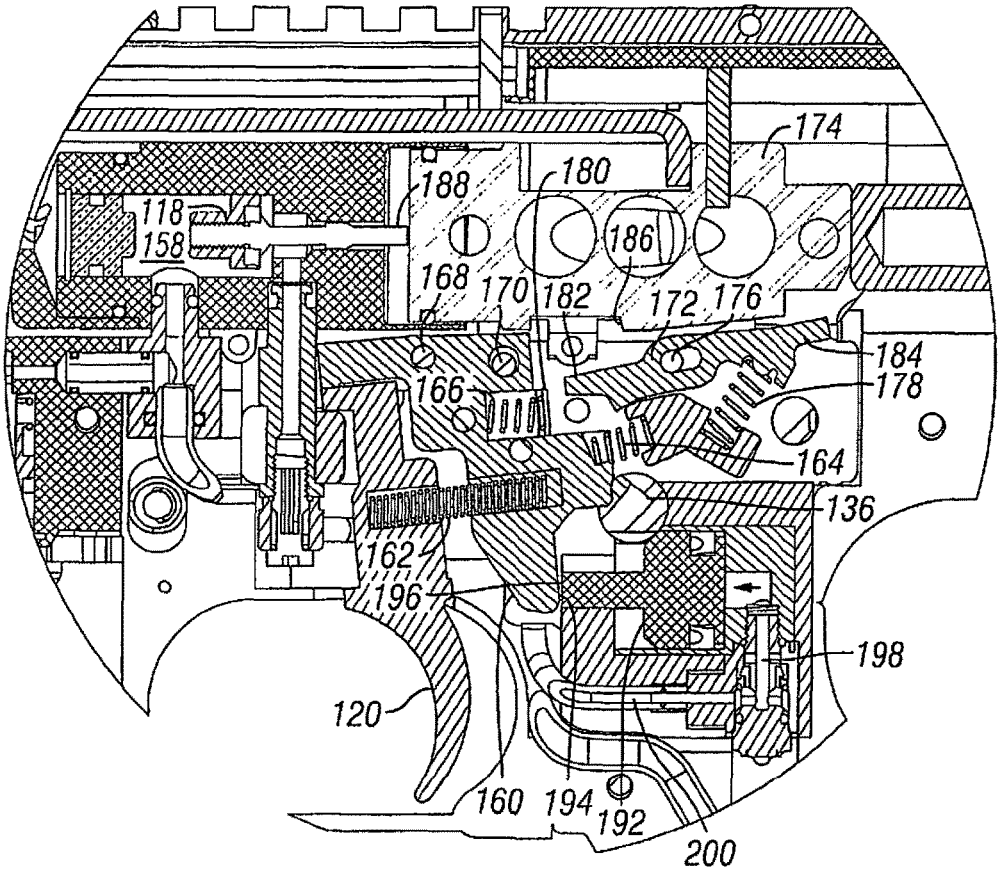

FIG. 17 shows the projectile launcher 100 after the trigger 120 has been pulled by the user. As with the semi-automatic mode, the force of spring 162 is sufficient so that trigger assist 160 moves to actuate the sear 172, which releases the rear bolt 174. The drive spring 173 urges the rear bolt to impact the stem 188 of the valve assembly 118, as shown in FIG. 18, which vents the compressed gas from the chamber 158. As discussed above, the vented gas has three fluid paths in this embodiment. First, the vented gas is directed toward the projectile in the breech area, which propels the projectile out of the projectile launcher 100. Second, a fluid path is directed to the leading edge of the rear bolt 174 which causes the rear bolt 174 to travel rearward to be recocked. A third fluid path 200 directs compressed gas through flow control valve 198 to piston 192.

Figure 19:
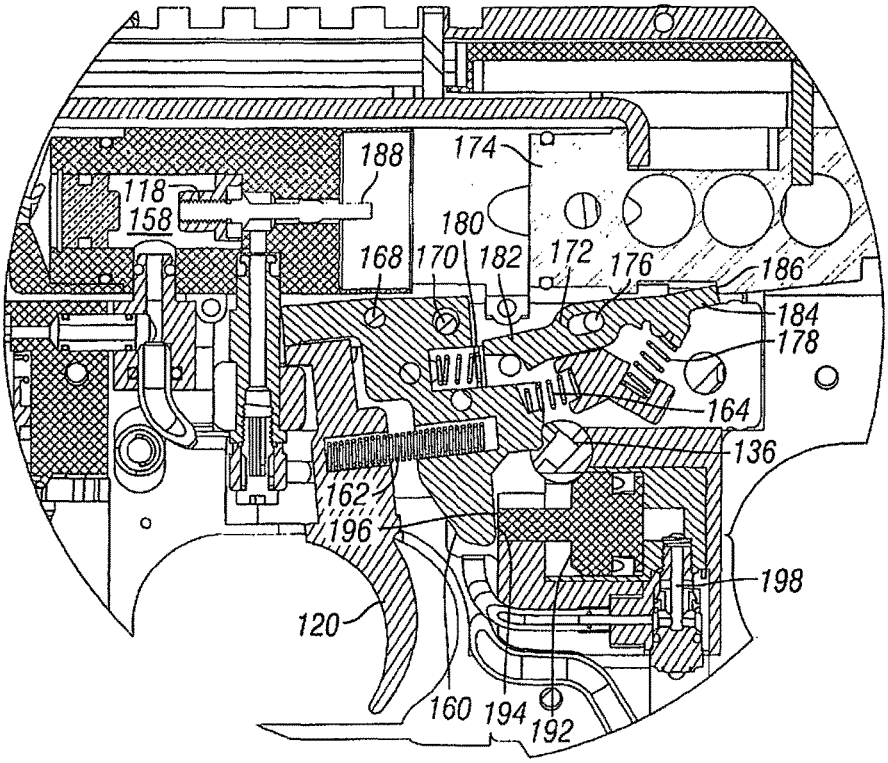

FIG. 19 shows the rear bolt 174 having traveled rearwardly to be recocked.

Figure 20:
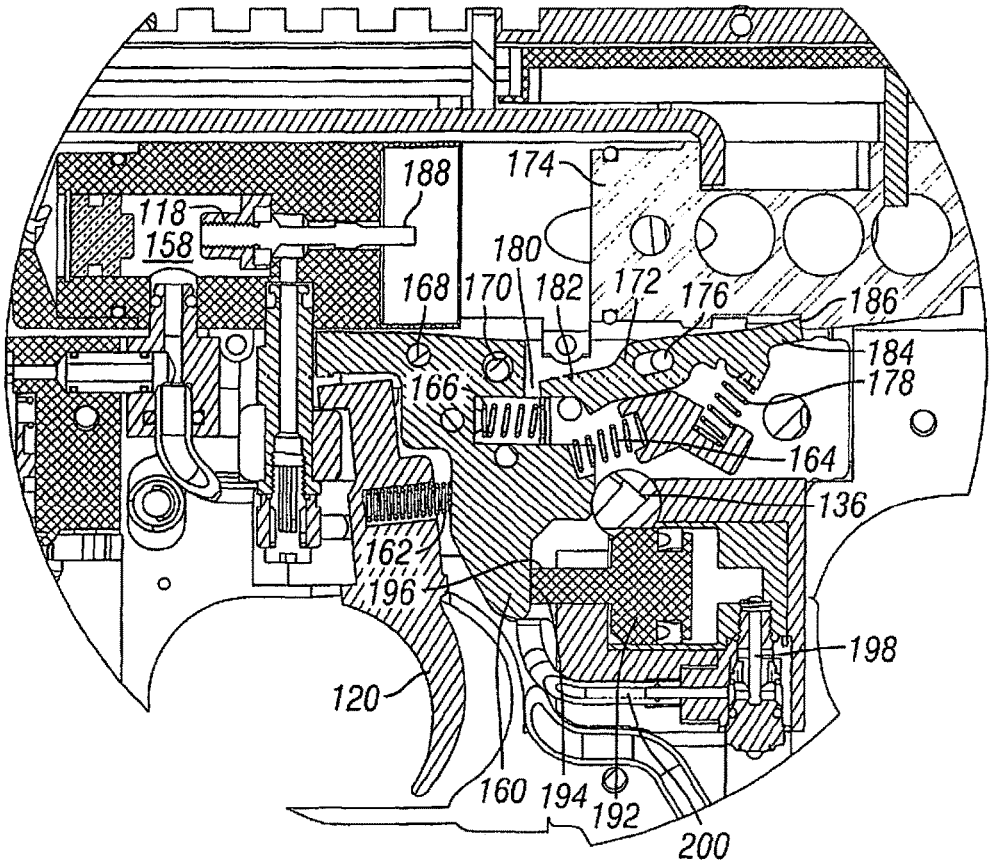
Figure 21:
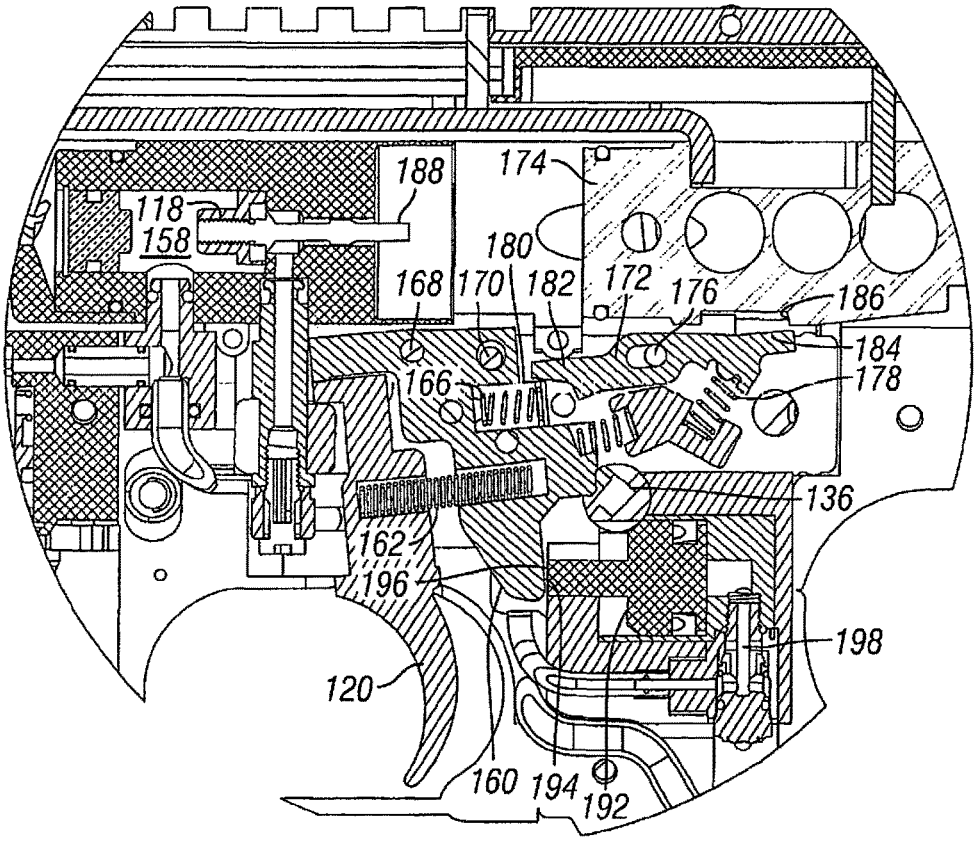

FIG. 20 shows the compressed gas directed to the piston 192 and shifted the piston 192 (leftward in this view) so that the leading end 196 has actuated the back portion 194 of the trigger assist 160 to reset the position of the trigger assist 160 overcoming the force of spring 162. In contrast of existing trigger assist devices, such as U.S. Pat. No. 6,550,468 for a "Trigger Assist Mechanism and Method," the trigger 120 does not move when the trigger assist 160 is reset. Accordingly, the user's trigger finger does not flutter back-and-forth when the launcher 100 goes through firing cycles. Instead, the trigger 120 stays in the same position when the user continues to pull the trigger 120 to continue firing. Since the user has continued to pull the trigger 120 in this example, when the piston 192 shifts back to its original position, the spring 162 urges the first end 182 of the sear 172, thereby releasing the rear bolt, as shown in FIG. 21. Through this action, the rear bolt will cause the firing of the projectile launcher 100 repeatedly as the user continues to pull the trigger 120. In this manner, the piston 192 will reciprocate back and forth as compressed gas is vented from the chamber 158 to reset the trigger assist 160 against the force of the spring 162, thereby continuing to fire the projectile launcher 100.

Figure 22:
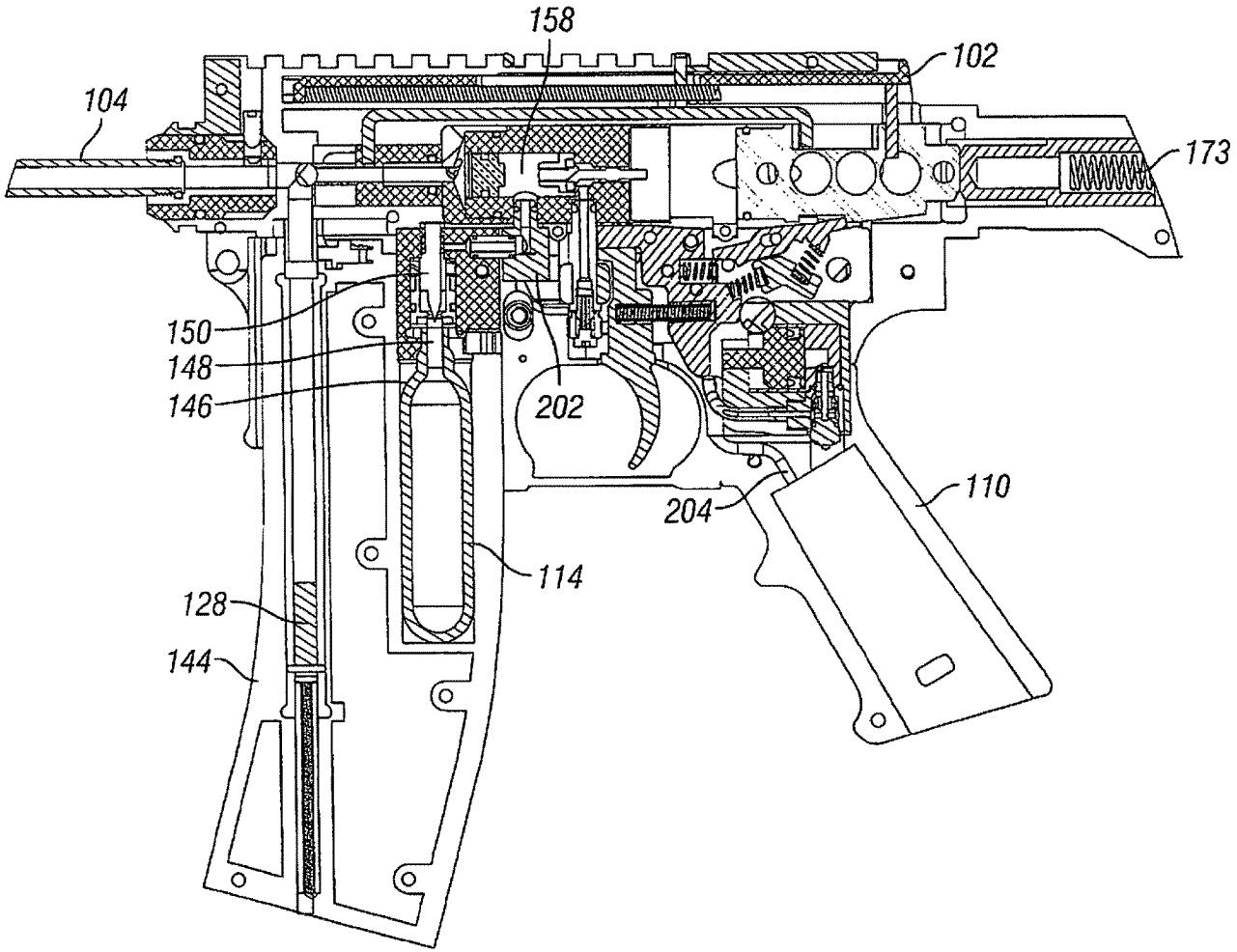
FIG. 22 is a detailed side cross-sectional view of the projectile launcher showing an example input fitting according to one embodiment of the invention.

FIG. 22 is a side cross-sectional view of the projectile launcher 100 with an input fitting 202 defining a fluid path between the cartridge 114 and the chamber 158. With the input fitting 202, this blocks the fluid path 204 to a remote line or tank adapter, as shown in other figures.

Figure 23:
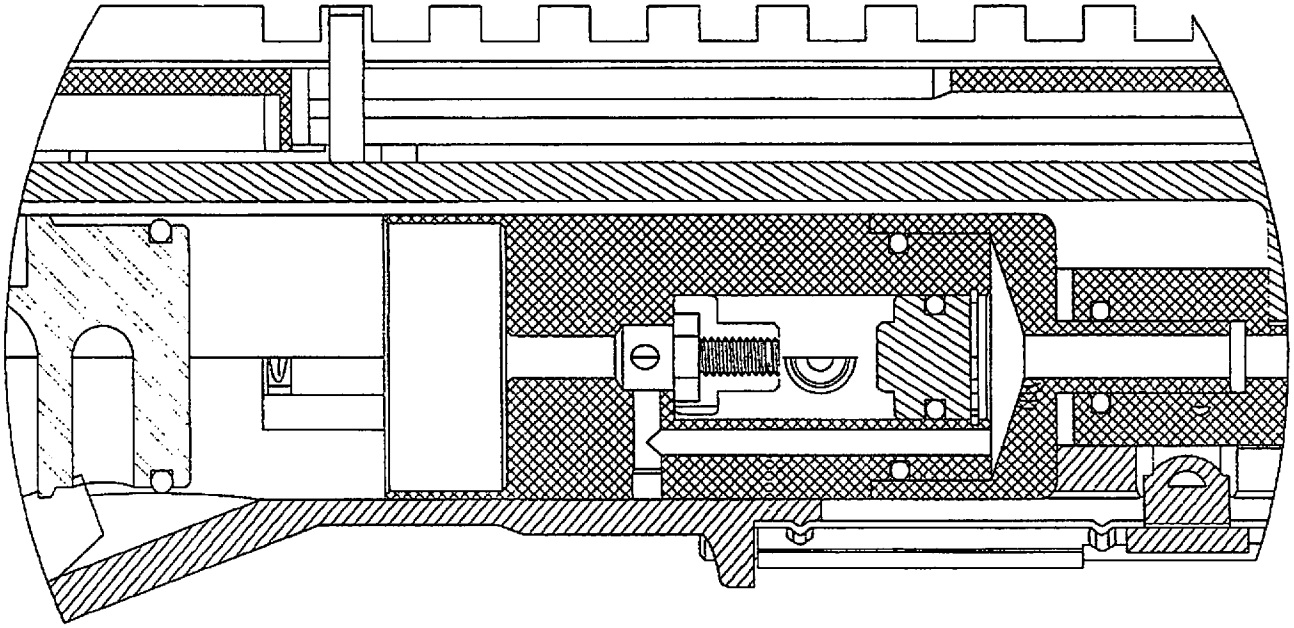
FIGS. 23-25 are cross-sectional views showing flow paths from the valve assembly according to one embodiment of the invention.
Figure 24:
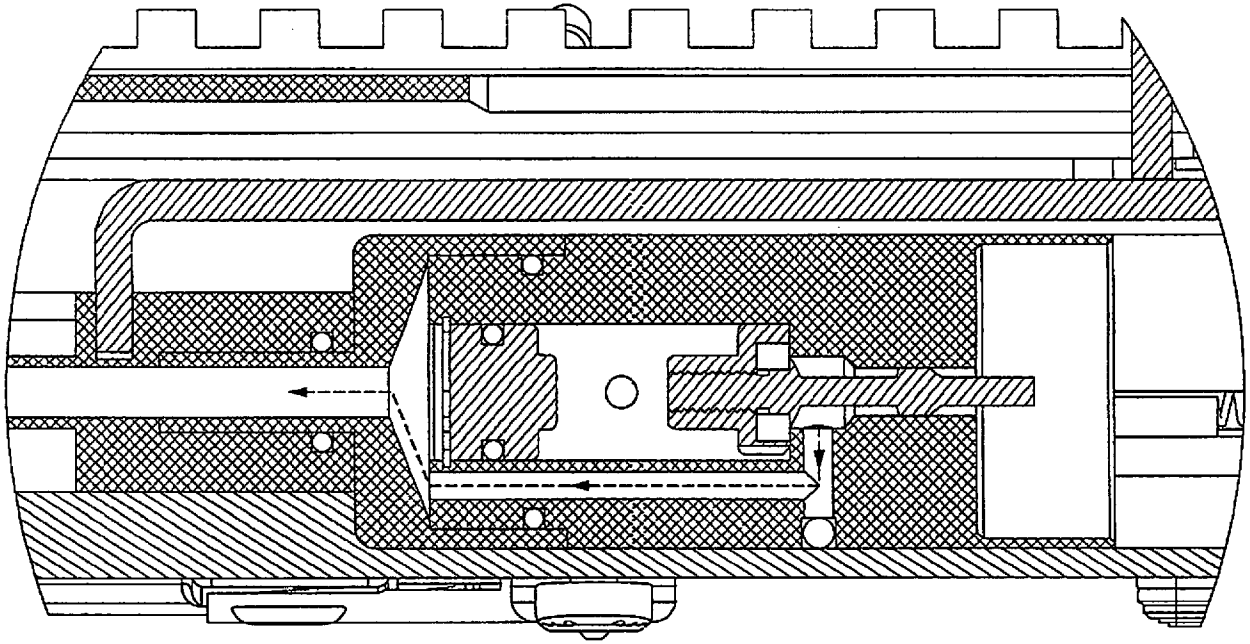

FIGS. 23 and 24 show fluid paths to the projectile, rear bolt 174, and piston 192.

Figure 25:
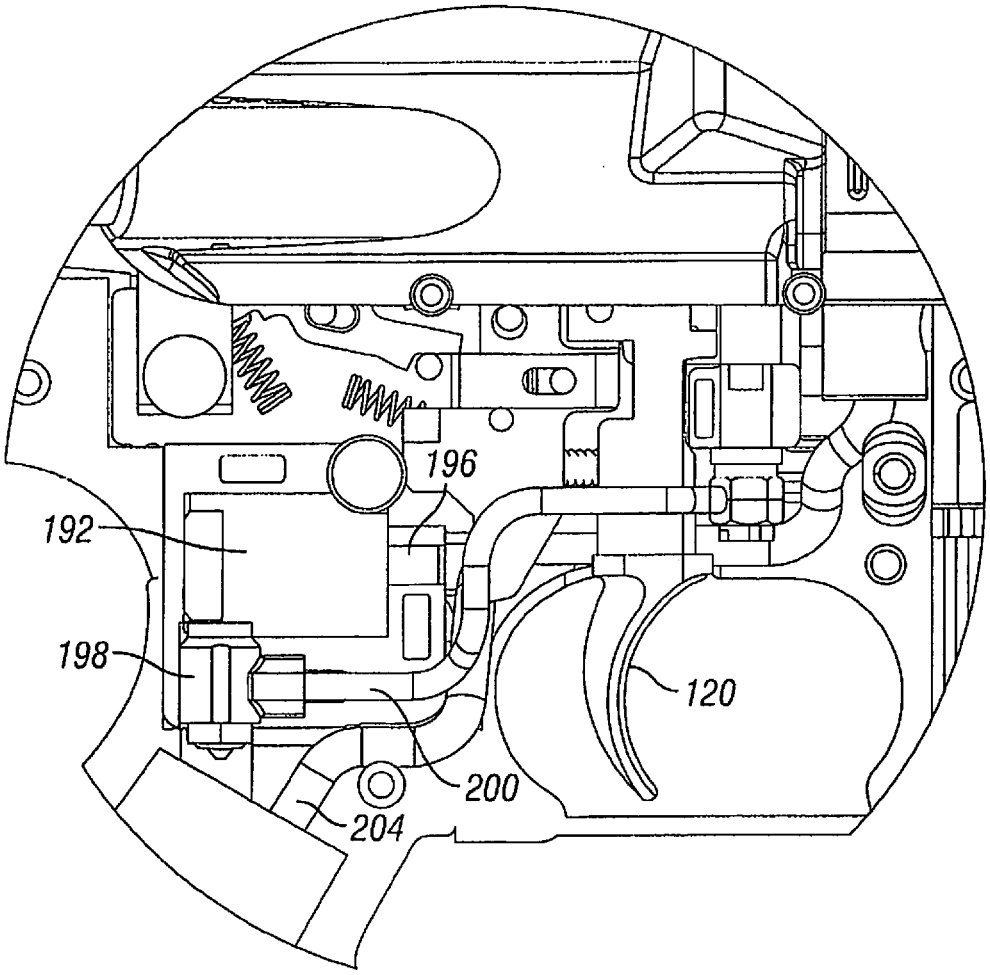

FIG. 25 shows the fluid path 200 to the piston 192 through the flow control valve 198. In this embodiment, the user may adjust the amount of flow through the flow control valve 198, which affects the speed by which the piston 192 reciprocates in full automatic mode. In this manner, the user can control the rate of fire of the projectile launcher 100 in the full automatic mode. In some embodiments, the flow control valve 198 may only restrict flow from the piston 192. In such embodiments, the piston 192 would extend the trigger assist 160 with full movement, but would restrict with a slower movement.

Figure 26:
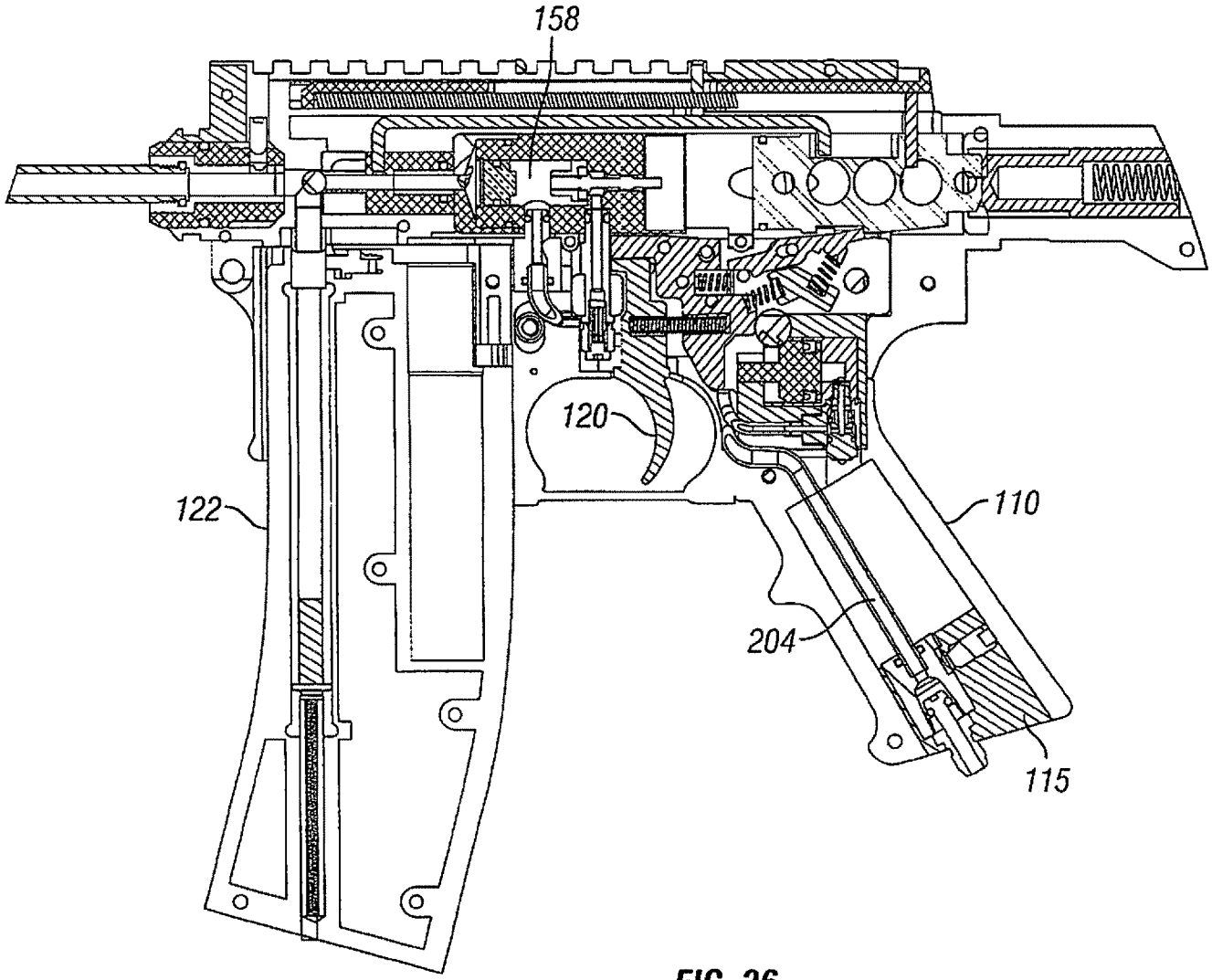
FIG. 26 is a side cross-sectional view of the example projectile launcher showing an input fitting distributing compressed gas from a remote line fitting to a valve assembly.

FIG. 26 shows an embodiment with an input fitting that allows fluid flow between fluid path 204 and the chamber 158. In this manner, a remote line fitting 115 may be attached with a grip 110 for remotely connecting a compressed gas cylinder. In this configuration, the remote line would supply compressed gas to the projectile launcher 100.

FIG. 27 is similar to FIG. 26, but with a tank adapter 116 connected to the grip 110 instead of a remote line fitting 115. Accordingly, the projectile launcher 100 could be used with either a compressed gas tank that is directly connected to the tank adapter 116, or through a remote cylinder of compressed gas using the remote line fitting 115.

Figure 28:
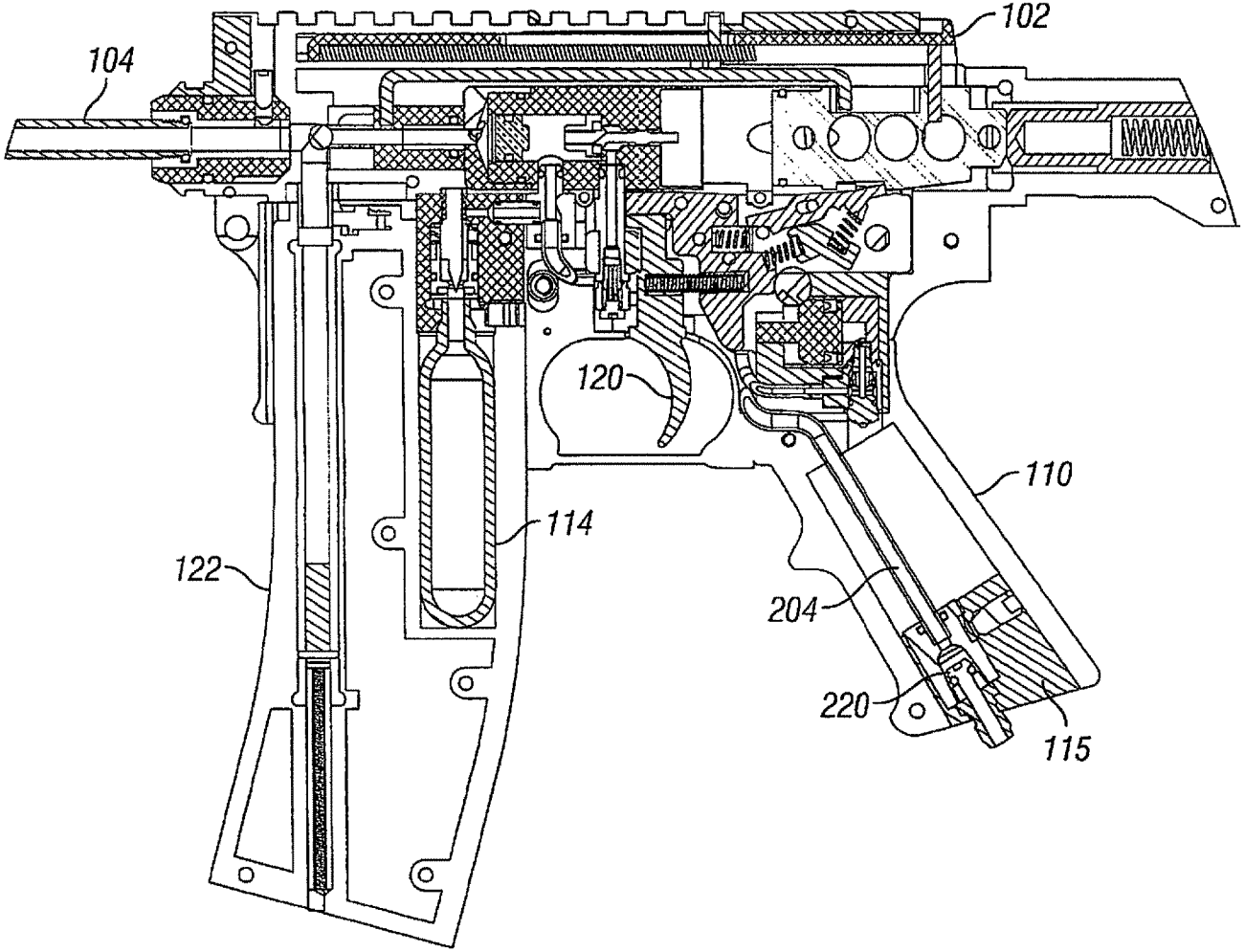
FIG. 28 is a side cross-sectional view of the example projectile launcher showing an input fitting distributing compressed gas from a remote line fitting or cartridge to a valve assembly.

FIG. 28 shows an embodiment in which the input fitting allows flow between either the cartridge 114 or the remote line fitting 115.

Figure 29:
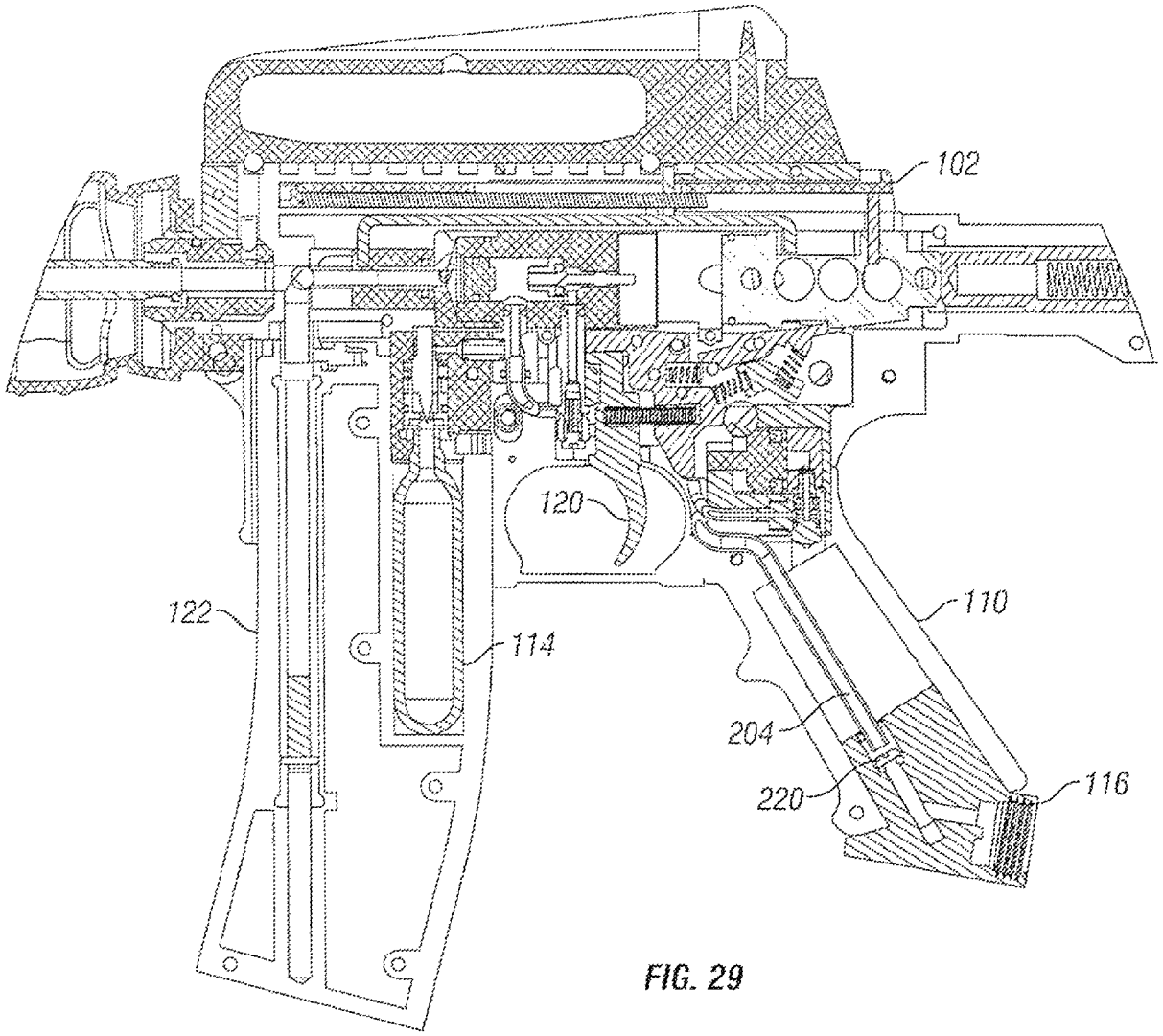
FIG. 29 is a side cross-sectional view of the example projectile launcher showing an input fitting distributing compressed gas from a remote line fitting or tank adapter to a valve assembly.

FIG. 29 is similar to FIG. 28 but with a tank adapter 116, rather than the remote line fitting 115 attached to the grip 110.

Accordingly, the launcher 100 may be supplied compressed gas using multiple configurations. For example, the user may decide to supply compressed gas using a cartridge 114. In such a configuration, the user would place a new cartridge 114 into the cavity 144 of the magazine 122 and then insert the magazine 122 into the receiver 102 with sufficient force such that the piercing pin 150 pierces a seal covering the mouth 148 of the cartridge 114. Compressed gas will then flow out of the cartridge 114 through the input fitting 202 into the chamber 158. It would be the user's choice whether to have a remote line 115 or tank adapter 116 attached to the grip, such as shown in FIGS. 28 and 29. With this configuration, a check valve 220 in the remote line 115 or tank adapter 116 prevents compressed gas from being released out the grip 110. Although this would allow quick change over to a tank or remote canister from the cartridge 114, the user may prefer to remove the remote line 115 or tank adapter 116 for a more realistic appearance, such as shown in FIG. 22. In this configuration, the input fitting 202 blocks the flow to fluid path 204. Accordingly, the input fitting 202 prevents escape of compressed gas out the grip 110 by blocking fluid path 204.

In some circumstances, the user may want to configure the launcher 100 to be supplied with compressed gas from either a canister connected to the remote line 115 or a tank connected with the tank adapter 116. With either of these configurations, the user may place a used cartridge 114 into the cavity 144. The seal 158 surrounding the mouth 148 of the cartridge 114 prevents compressed gas from escaping out the magazine 144. If the user does not want to place a used cartridge 114 into the cavity 144, an input fitting 202 could be used to block the fluid path normally used for supplying compressed gas from a cartridge 114, which prevents escape of compressed gas from the magazine 144. In some embodiments a check valve could be used to prevent escape of compressed gas from the magazine 144. In some circumstances, the puncture assembly could be removed from the receiver 102, such as shown in FIGS. 26-27. With the puncture assembly removed, the user could use a high-capacity magazine with the launcher 100, which would hold more projectiles than magazine 122. For example, the receiver 102 may be compatible with certain after-market or third party high-capacity magazines with the puncture assembly removed. The G&G 450 Rounds Hi-Cap Airsoft Gun Magazine by G&G or the KWA M4/M16 A.E.G. 360 rds HI-CAP Airsoft Magazine, which are both available on Amazon.com, are examples of high capacity magazines that could be used.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A projectile launcher comprising:

a barrel dimensioned to receive a projectile, wherein the barrel extends longitudinally along a barrel axis;

a magazine dimensioned to carry a plurality of projectiles, wherein the magazine includes a cavity dimensioned to receive a cartridge of compressed gas, wherein a longitudinal axis defined by the magazine extends transverse to the barrel axis;

a receiver including a breech proximate to the barrel, wherein the receiver includes an opening dimensioned to receive the magazine, wherein the receiver includes a puncture mechanism configured to pierce a seal of the compressed gas cartridge disposed in the cavity of the magazine;

a valve assembly configured to selectively allow flow between a source of compressed gas and the breech;

a firing assembly configured to actuate the valve assembly responsive to a trigger pull; and wherein the puncture mechanism includes a piercing pin with a tip covered by a spring-loaded wall, wherein a force applied by insertion of the magazine overcomes the spring-loaded wall to expose the tip of the piercing pin.

2. The projectile launcher as recited in claim 1, wherein one or more of the receiver or the magazine include a latch mechanism configured to releasably couple the magazine to the receiver.

3. The projectile launcher as recited in claim 2, wherein the latch mechanism is configured to allow coupling of the magazine to the receiver by inserting the magazine into the receiver with a force less than a sufficient force to move the spring-loaded wall.

4. The projectile launcher as recited in claim 1, wherein the receiver defines a first flow path between the magazine and the valve assembly.

5. The projectile launcher as recited in claim 4, wherein the receiver defines a second flow path between the valve assembly and a grip portion of the receiver; and wherein the second flow path terminates in the grip portion with one of a tank adapter or a remote line fitting.

* * * * *